US007780162B2

(12) United States Patent
Kaneko et al.

(10) Patent No.: US 7,780,162 B2
(45) Date of Patent: Aug. 24, 2010

(54) PAPER SUPPLY APPARATUS

(75) Inventors: Hidetoshi Kaneko, Yamatokoriyama (JP); Toshihiko Seike, Nara (JP); Masatsugu Ohishi, Nara (JP); Kengo Matsuyama, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 872 days.

(21) Appl. No.: 10/901,227

(22) Filed: Jul. 29, 2004

(65) Prior Publication Data

US 2006/0022397 A1 Feb. 2, 2006

(51) Int. Cl.
*B65H 1/00* (2006.01)

(52) U.S. Cl. ..... 271/171; 74/422; 74/462

(58) Field of Classification Search ..... 271/171, 271/238, 240; 74/422, 462, 409, 440; 399/393
See application file for complete search history.

(56) References Cited

U.S. PATENT DOCUMENTS

| | | | | | |
|---|---|---|---|---|---|
| 674,447 | A * | 5/1901 | Mase | 74/422 |
| 2,785,893 | A * | 3/1957 | Ford et al. | 271/169 |
| 3,753,378 | A * | 8/1973 | Bishop | 74/422 |
| 3,861,231 | A * | 1/1975 | F'Geppert | 74/410 |
| 3,926,061 | A * | 12/1975 | Paulson | 74/22 R |
| 4,036,073 | A * | 7/1977 | Kitano | 74/393 |
| 4,444,070 | A * | 4/1984 | Yanai | 74/422 |
| 4,475,413 | A * | 10/1984 | Higuchi | 74/422 |
| 4,549,591 | A * | 10/1985 | Hyggen | 152/218 |
| 4,907,792 | A * | 3/1990 | Washiashi et al. | 271/240 |
| 5,163,670 | A * | 11/1992 | Sellers et al. | 271/157 |
| 5,927,707 | A * | 7/1999 | Miura | 271/171 |
| 5,988,621 | A * | 11/1999 | Kondo et al. | 271/3.02 |
| 6,014,229 | A * | 1/2000 | Yun | 358/449 |
| 6,260,839 | B1 * | 7/2001 | Araki et al. | 271/10.11 |
| 6,454,254 | B2 * | 9/2002 | Yamaguchi et al. | 271/171 |
| 6,581,926 | B2 * | 6/2003 | Hsiao et al. | 271/171 |
| 6,805,345 | B2 * | 10/2004 | Furukawa | 271/171 |
| 6,935,629 | B2 * | 8/2005 | Asada | 271/171 |
| 7,004,462 | B2 * | 2/2006 | Bryer | 271/171 |

FOREIGN PATENT DOCUMENTS

| | | | |
|---|---|---|---|
| JP | 01267222 | A * | 10/1989 |
| JP | 9110193 | | 4/1997 |
| JP | 10129856 | | 5/1998 |
| JP | 2001205539 | | 7/2001 |
| JP | 2002154669 | | 5/2002 |

* cited by examiner

*Primary Examiner*—Richard W Ridley
*Assistant Examiner*—Michael C McCullough
(74) *Attorney, Agent, or Firm*—Birch, Stewart, Kolasch & Birch, LLP

(57) ABSTRACT

Rack gears of far-side paper guides are provided such that manners of meshing with pinion gears are made tighter at respective regions corresponding to locations for constraining paper of standard size, as compared to other regions. In addition, by constituting width guide plates which are upstream in a paper feed directions from far-side paper guides and width guide plates which are downstream in a paper feed directions therefrom such that respective areas of surfaces receiving paper, and respective distances from respective width guide plates to gear mesh locations, are respectively set so as to be substantially mutually equal. Impacts from stacks of paper produced during placement of paper within a paper supply apparatus may be received substantially equal at upstream and downstream from gear mesh of far-side paper guides, and torques acting on far-side paper guides upstream and downstream from gear mesh locations may be made substantially mutually equal.

17 Claims, 13 Drawing Sheets

PAPER SUPPLY APPARATUS

BACKGROUND OF INVENTION

1. Field of the Invention

The present invention pertains to a paper supply apparatus (paper feed cassette) capable of being used in a copier, printer, or other such image forming apparatus, and more specifically pertains to a paper supply apparatus capable of being used in a front-loading-type image forming apparatus in which placement of paper therein is accomplished as a result of operations carried out at the near side of the apparatus.

1. Description of the Related Art

A front-loading-type image forming apparatus might be such that an original stage, scanning unit, image forming unit, and discharge tray are arranged at the upper part of what is, for example, a vertically oriented apparatus main body; and such that a paper feed unit is arranged at the lower part thereof. The paper feed unit might be equipped with a cassette compartment, the paper supply apparatus (paper feed cassette) being loaded into the cassette compartment upon being pushed from the near side of the apparatus main body toward the far side thereof. Furthermore, during filling of the paper feed cassette, placement of paper therein might be accomplished by means of a sequence in which the paper feed cassette is pulled out to the near side of the apparatus, paper is placed within the paper feed cassette, and the paper feed cassette is thereafter again pushed thereinto.

As shown in FIG. 17, as an example of a paper supply apparatus capable of being used in such a front-loading-type image forming apparatus, there is paper feed cassette 401 which is provided with a positioning mechanism made up of two paper guides 431, 432 having rack gears 433, 434; paper-separating tabs 435, 436; pinion gear 404 meshing with respective paper guide rack gears 433, 434; paper trail edge plate 406; and so forth (see, e.g., Japanese Patent Application Publication Kokai No. H10-129856 (1998)).

At paper feed cassette 401 shown in FIG. 17, the paper feed direction is perpendicular to the direction in which the cassette is inserted into the image forming apparatus (loading direction). Furthermore, in order to facilitate filling of paper feed cassette 401 with paper, paper guides 431, 432—respectively located at the far and near sides thereof—are arranged so as to permit sliding motion in the loading direction. These two paper guides 431, 432 are such that respective rack gears 433, 434 mesh, as has been said, with a single pinion gear 404, movement of one of the paper guides (e.g., near-side paper guide 431) causing the other paper guide (far-side paper guide 432) to move in linked fashion therewith. Moreover, as shown in FIG. 18, paper feed cassette 401 is provided with rotating plate 407 for lifting upward the paper which has been placed within paper feed cassette main body 402.

However, with a conventional paper feed cassette such as that capable of being used in a front-loading-type image forming apparatus, because during placement of paper therein a user might position a stack of paper by causing same to strike and abut the far-side paper guide, thereafter lowering the near side of the paper into the cassette, a large impact might be exerted on the far-side paper guide. Furthermore, after the paper has been placed within the paper feed cassette, when the paper feed cassette is pushed into the image forming apparatus, an impact occurring at the conclusion of insertion of the cassette, i.e., an impact arising due to the weight of the paper, might again be exerted on the far-side paper guide. Because impact exerted on the far-side paper guide in such fashion during placement of paper within the paper feed cassette and/or insertion of the paper feed cassette into the image forming apparatus can cause mechanical play to arise in the far-side paper guide, affecting positioning of the paper guide, this may produce variation in location(s) at which paper is constrained by guide(s) and/or failure of paper to be held by paper-separating tab(s).

The present invention was conceived in order to eliminate such problems, and provides a paper supply apparatus permitting elimination of paper transport problems and capable of preventing de-positioning of paper guide(s) and/or the like that might otherwise occur during filling of paper feed cassette(s) in the context of front-loading-type image processing apparatus(es).

SUMMARY OF INVENTION

A paper supply apparatus in accordance with one or more embodiments of the present invention is capable of being loaded into one or more front-loading-type image forming apparatuses and permits placement of paper therein as a result of removal/insertion operations carried out at least one near side of at least one of the image forming apparatus or apparatuses, the paper supply apparatus comprising at least one near-side paper guide and at least one far-side paper guide respectively arranged so as to oppose one another, each having at least one rack gear extending in at least one direction more or less parallel to one or more loading directions; and at least one pinion gear respectively meshing with at least one of the rack gear or gears of at least one of the near-side paper guide or guides and at least one of the rack gear or gears of at least one of the far-side paper guide or guides; wherein at least one paper feed direction is more or less perpendicular to at least one of the loading direction or directions; and at least one of the rack gear or gears of at least one of the far-side paper guide or guides is provided, at least one specific location thereof in at least one of the loading direction or directions (long direction(s) of rack gears(s)), with at least one region at which at least one manner of meshing between at least one of the pinion gear or gears and the at least one rack gear of the at least one far-side paper guide is different from at least one manner of meshing therebetween at one or more other portions thereof.

More specifically, at least one of the specific region or regions at which at least one manner of meshing with at least one of the pinion gear or gears is different may be at least one region corresponding to at least one location for constraining at least one standard size of paper capable of being contained within the paper supply apparatus; at least one manner of meshing at least one of the specific region or regions may be tight; and at least one manner of meshing at least one of the different portion or portions may be loose. Furthermore, in the case of a paper supply apparatus (so-called "universal cassette") capable of containing a plurality of standard sizes of paper, the at least one specific region at which at least one manner of meshing with at least one of the pinion gear or gears is different may be a plurality of regions corresponding to respective locations for constraining such plurality of standard sizes of paper; at least one manner of meshing at the plurality of specific regions being tight; and at least one manner of meshing at least one of the different portion or portions being loose.

Moreover, as an example of an embodiment in which at least one of the specific region or regions at which at least one manner of meshing with at least one of the pinion gear or gears is different, a profile-shifted rack gear having gear teeth (multiple teeth) with profile shift(s) relative to the reference line may be cited.

In a paper supply apparatus in accordance with such embodiment(s) of the present invention, when paper guide(s) is/are at location(s) for constraining paper of standard size(s), manner(s) of meshing between pinion gear(s) and rack gear (s) of paper guide(s) will be tight. That is, there will be reduced backlash between rack gear(s) and pinion gear(s), and there will be reduced mechanical play at paper guide(s). It will accordingly be possible, despite occurrence of force(s) acting on far-side paper guide(s) due to impact(s) during placement of paper within paper feed cassette(s) and/or insertion of paper feed cassette(s) into image forming apparatus (es), to reduce de-positioning of paper guide(s) and so forth.

On the other hand, when paper guide(s) is/are at location(s) (paper guide translational region(s)) other than location(s) for constraining paper of standard size(s), manner(s) of meshing between pinion gear(s) and rack gear(s) will go from tight to loose. That is, because there will be increased backlash between rack gear(s) and pinion gear(s), it will be possible to cause paper guide(s) to move with application of less force and it will be possible to cause operations which are carried out when moving paper guide(s) in sliding fashion, e.g., to location(s) for constraining paper or the like, to be accomplished smoothly.

Moreover, region(s) at which manner(s) of meshing is/are different such as has been described above may alternatively or additionally be provided at rack gear(s) of near-side paper guide(s).

A paper supply apparatus in accordance with one or more embodiments of the present invention is capable of being loaded into one or more front-loading-type image forming apparatuses and permits placement of paper therein as a result of removal/insertion operations carried out at least one near side of at least one of the image forming apparatus or apparatuses, the paper supply apparatus comprising at least one near-side paper guide and at least one far-side paper guide respectively arranged so as to oppose one another, each having at least one rack gear extending in at least one direction more or less parallel to one or more loading directions; and at least one pinion gear respectively meshing with at least one of the rack gear or gears of at least one of the near-side paper guide or guides and at least one of the rack gear or gears of at least one of the far-side paper guide or guides; wherein at least one paper feed direction is more or less perpendicular to at least one of the loading direction or directions; at least one of the rack gear or gears of at least one of the far-side paper guide or guides is provided, at least one prescribed location thereof in at least one of the loading direction or directions, with at least one projection for pushing at least one tooth of at least one of the rack gear or gears at that portion or those portions thereof toward at least one of the pinion gear or gears; the supply apparatus main body is provided with at least one thrust member (e.g., at least one projection at least one rail) capable of pressing on at least one of the rack gear projection or projections; and the paper supply apparatus is constituted such that when at least one of the paper guides is disposed at least one location for constraining one or more standard sizes of paper capable of being contained within the paper supply apparatus, at least one of the supply apparatus main body thrust member or members comes in contact with at least one of the rack gear projection or projections, causing at least one manner in which at least one of the rack gear or gears meshes with at least one of the pinion gear or gears to become tight.

In a paper supply apparatus in accordance with such embodiment(s) of the present invention, when paper guide(s) is/are at location(s) for constraining paper of standard size(s), rack gear projection(s) is/are pressed on by thrust member(s) at paper supply apparatus main body or bodies, causing manner(s) of meshing between pinion gear(s) and rack gear(s) at such pressed location(s) to be tight. That is, there will be reduced backlash between rack gear(s) and pinion gear(s), and there will be reduced mechanical play at paper guide(s). It will accordingly be possible, despite occurrence of force(s) acting on far-side paper guide(s) due to impact(s) during placement of paper within paper feed cassette(s) and/or insertion of paper feed cassette(s) into image forming apparatus (es), to reduce de-positioning of paper guide(s) and so forth.

On the other hand, when paper guide(s) is/are at location(s) (paper guide translational region(s)) other than location(s) for constraining paper of standard size(s), because thrust member(s) at projection(s) at rack gear(s) will not come in contact therewith and manner(s) of meshing between rack gear(s) and pinion gear(s) will no longer be tight but will return to its/their normal state(s) (manner(s) of meshing will become loose), it will be possible to cause paper guide(s) to move with application of less force and it will be possible to cause operations which are carried out when moving paper guide(s) in sliding fashion, e.g., to location(s) for constraining paper or the like, to be accomplished smoothly.

Here, in paper supply apparatus(es) in accordance with embodiment(s) of the present invention, by, for example, constituting width guide plate(s) (paper constraining plate(s)) which is/are located upstream in paper feed direction(s) from far-side paper guide(s) and width guide plate(s) which is/are located downstream in paper feed direction(s) therefrom such that areas of surfaces receiving paper, and distances from respective width guide plates to gear mesh location(s) (location(s) at which rack gear(s) and pinion gear(s) are meshingly engaged), are respectively set so as to be more or less mutually equal, it is possible to cause impact(s) from stack(s) of paper produced during placement of paper within paper supply apparatus(es) and/or insertion of paper supply apparatus (es) into image forming apparatus(es) to be received more or less equally upstream and downstream from gear mesh location(s) of far-side paper guide(s). Adoption of such a constitution will make it possible to cause torques acting on far-side paper guide(s) upstream and downstream from gear mesh location(s) to be made more or less mutually equal, making it possible to prevent deformation of far-side paper guide(s). As a result, it is possible to prevent de-positioning of paper placed therein at image forming apparatus(es) and/or paper transport problems that might otherwise occur in accompaniment thereto.

A paper supply apparatus in accordance with one or more embodiments of the present invention is capable of being loaded into one or more front-loading-type image forming apparatuses and permits placement of paper therein as a result of removal/insertion operations carried out at least one near side of at least one of the image forming apparatus or apparatuses, the paper supply apparatus comprising at least one near-side paper guide and at least one far-side paper guide respectively arranged so as to oppose one another, each having at least one width guide plate for constraining at least a portion of the paper and at least one rack gear extending in at least one direction more or less parallel to one or more loading directions; and at least one pinion gear respectively meshing with at least one of the rack gear or gears of at least one of the near-side paper guide or guides and at least one of the rack gear or gears of at least one of the far-side paper guide or guides; wherein at least one paper feed direction is more or less perpendicular to at least one of the loading direction or directions; and at least one of the far-side paper guide or guides is constituted such that, with respect to at least one gear mesh location at which at least one of the pinion gear or gears and at least one of the far-side paper guide rack gear or gears mutually mesh, at least one product of at least one area of at least one surface of at least one of the width guide plates that receives at least a portion of the paper and that is upstream, being located upstream in at least one of the paper feed direction or directions, and at least one distance (distance in at least one of the paper feed directions or directions) from at least one center of at least one of the upstream paper-receiving surface or surfaces to at least one of the gear mesh location or locations is more or less equal to at least one product of at least one area of at least one surface of at least one of the width guide plates that receives at least a portion of the paper and that is downstream, being located downstream in at least one of the paper feed direction or directions, and at least one distance (distance in at least one of the paper feed directions or directions) from at least one center of at least one of the downstream paper-receiving surface or surfaces to at least one of the gear mesh location or locations.

In such embodiment(s) of the present invention, because of the condition applicable to upstream side(s) and downstream side(s) in paper feed direction(s) from far-side paper guide(s), i.e., because products of areas of surfaces receiving paper and distances to gear mesh location(s) are set so as to be more or less equal upstream and downstream, even where impact(s) from stack(s) of paper produced during placement of paper within paper supply apparatus(es) and/or insertion of paper supply apparatus(es) into image forming apparatus(es) act on far-side paper guide(s), it will be possible to cause torques produced as a result of forces from such impact(s) to be made more or less equal upstream and downstream from gear mesh location(s). As a result, deformation of far-side paper guide(s) can be prevented, and it is possible to prevent de-positioning of paper placed therein and/or paper transport problems that might otherwise occur in accompaniment thereto.

A paper supply apparatus in accordance with one or more embodiments of the present invention is capable of being loaded into one or more front-loading-type image forming apparatuses and permits placement of paper therein as a result of removal/insertion operations carried out at least one near side of at least one of the image forming apparatus or apparatuses, the paper supply apparatus comprising at least one near-side paper guide and at least one far-side paper guide respectively arranged so as to oppose one another, each having at least one width guide plate for constraining at least a portion of the paper and at least one rack gear extending in at least one direction more or less parallel to one or more loading directions; and at least one pinion gear respectively meshing with at least one of the rack gear or gears of at least one of the near-side paper guide or guides and at least one of the rack gear or gears of at least one of the far-side paper guide or guides; wherein at least one paper feed direction is more or less perpendicular to at least one of the loading direction or directions; at least one of the far-side paper guide or guides is constituted such that, with respect to at least one gear mesh location at which at least one of the pinion gear or gears and at least one of the far-side paper guide rack gear or gears mutually mesh, at least one area of at least one surface of at least one of the width guide plates that receives at least a portion of the paper and that is upstream, being located upstream in at least one of the paper feed direction or directions, is more or less equal to at least one area of at least one surface of at least one of the width guide plates that receives at least a portion of the paper and that is downstream, being located downstream in at least one of the paper feed direction or directions; and at least one distance (distance in at least one of the paper feed directions or directions) between at least one upstream end of at least one of the upstream width guide plate or plates and at least one of the gear mesh location or locations is more or less equal to at least one distance (distance in at least one of the paper feed directions or directions) between at least one downstream end of at least one of the downstream width guide plate or plates and at least one of the gear mesh location or locations.

In such embodiment(s) of the present invention, because of the condition applicable to upstream side(s) and downstream side(s) in paper feed direction(s) from far-side paper guide(s), i.e., because areas of surfaces receiving paper and distances to gear mesh location(s) are set so as to be more or less equal upstream and downstream, impact(s) from stack(s) of paper produced during placement of paper within paper supply apparatus(es) and/or insertion of paper supply apparatus(es) into image forming apparatus(es) may be received more or less equally upstream and downstream from far-side paper guide(s) (upstream and downstream from gear mesh location (s)), and torques acting on far-side paper guide(s) upstream and downstream from gear mesh location(s) may be made more or less mutually equal. As a result, deformation of far-side paper guide(s) can be prevented, and it is possible to prevent de-positioning of paper placed therein and/or paper transport problems that might otherwise occur in accompaniment thereto.

A paper supply apparatus in accordance with one or more embodiments of the present invention is capable of being loaded into one or more front-loading-type image forming apparatuses and permits placement of paper therein as a result of removal/insertion operations carried out at least one near side of at least one of the image forming apparatus or apparatuses, the paper supply apparatus comprising at least one near-side paper guide and at least one far-side paper guide respectively arranged so as to oppose one another, each having at least one width guide plate for constraining at least a portion of the paper and at least one rack gear extending in at least one direction more or less parallel to one or more loading directions; and at least one pinion gear respectively meshing with at least one of the rack gear or gears of at least one of the near-side paper guide or guides and at least one of the rack gear or gears of at least one of the far-side paper guide or guides; wherein at least one paper feed direction is more or less perpendicular to at least one of the loading direction or directions; and at least one of the far-side paper guide or guides is constituted such that the width guide plates thereof are disposed so that at least one torque, about at least one gear mesh location at which at least one of the pinion gear or gears and at least one of the far-side paper guide rack gear or gears mutually mesh, acting upstream in at least one of the paper feed direction or directions from at least one of the gear mesh locations or locations is more or less equal to at least one torque, about at least one of the gear mesh locations or locations, acting downstream in at least one of the paper feed direction or directions from at least one of the gear mesh locations or locations.

In such embodiment(s) of the present invention, even where impact(s) from stack(s) of paper produced during placement of paper within paper supply apparatus(es) and/or insertion of paper supply apparatus(es) into image forming apparatus(es) act on far-side paper guide(s), it will be possible to cause torques produced as a result of forces from such impact(s) to be made more or less equal upstream and downstream from gear mesh location(s), as a result of which it will be possible to prevent deformation of far-side paper guide(s) and it will be possible to prevent de-positioning of paper placed therein and/or paper transport problems that might otherwise occur in accompaniment thereto.

In the paper supply apparatus of one or more embodiments of the present invention, it is preferred that respective paper guide(s) be disposed so as to cause distance(s) (distance(s) in paper feed direction(s)) between upstream end(s) of width guide plate(s) of far-side paper guide(s) and gear mesh location(s) at which rack gear(s) of such far-side paper guide(s) and pinion gear(s) meshingly engage to be shorter than distance(s) (distance(s) in paper feed direction(s)) between upstream end(s) of width guide plate(s) of near-side paper guide(s) and gear mesh location(s) at which rack gear(s) of such near-side paper guide(s) and pinion gear(s) meshingly engage.

By disposing near-side paper guide(s) and far-side paper guide(s) so as to satisfy such condition(s), it is possible to cause torque(s) acting on far-side paper guide(s) due to force (s) from impact(s) during placement of paper within paper supply apparatus(es) and/or insertion of paper supply apparatus(es) into image forming apparatus(es) to be lessened and it is possible to reduce load(s) on far-side paper guide(s).

In the paper supply apparatus of one or more embodiments of the present invention, it is preferred that paper-separating tab(s) be respectively provided in integral fashion at near-side paper guide(s) and at far-side paper guide(s). By thus providing paper-separating tab(s) in integral fashion at respective paper guide(s), it will be possible merely by setting paper guide position(s) to simultaneously set paper-separating tab position(s), facilitating ease of operation during placement of paper therein.

It is preferred that the paper supply apparatus of one or more embodiments of the present invention be provided with deformation prevention means for preventing deformation of far-side paper guide(s).

As examples of means for preventing deformation of paper guide(s), rail(s) for preventing displacement (warpage) of paper guide baseplate(s) relative to paper supply apparatus main body or bodies (paper feed cassette main body or bodies), torsion-preventing member(s) for preventing torsion at region(s) at which rack gear(s) is/are formed, and/or the like may be cited.

Moreover, by providing such deformation prevention means and preventing deformation of paper guide baseplate (s), it is possible to prevent deformation (inclination) of width guide plate(s) receiving impact(s) from paper. That is, after placement of paper within paper supply apparatus(es) and/or insertion of paper supply apparatus(es) into image forming apparatus(es) is completed, width guide plate(s) of (far-side) paper guide(s) being pressed upon by the paper placed therein, width guide plate(s) can become inclined, in accompaniment to which paper guide baseplate(s) can become warped; but if warpage of such baseplate(s) is prevented, it is possible to reduce deformation of width guide plate(s).

Furthermore, the strength of region(s) at which rack gear(s) is/are formed on paper guide(s) being weak as compared with region(s) at which width guide plate(s) is/are formed, impact (s) produced during insertion of paper supply apparatus(es) into image forming apparatus(es) can cause deformation and/or breakage of rack gear(s); but by providing torsion-preventing member(s) imparting strength with respect to torsion and so forth at region(s) at which rack gear(s) is/are formed, it is possible to prevent rack gear deformation, damage, and/or the like. Note that torsion-preventing member(s) may be formed in integral fashion with respect to paper guide(s), and/or separately manufactured torsion-preventing member(s) may be attached to the paper guide.

In the paper supply apparatus of one or more embodiments of the present invention, it is preferred that at least one reinforcing plate be provided at either at least one top surface or at least one bottom surface of at least one of the pinion gear or gears. By thus reinforcing and increasing the strength of pinion gear(s) by means of reinforcing plate(s), it is possible to reduce deformation of pinion gear(s) despite action of large force(s) on pinion gear(s) during placement of paper within paper supply apparatus(es) and/or insertion of paper supply apparatus(es) into image forming apparatus(es). This makes it possible to prevent problems that might otherwise occur due to deformation of pinion gear(s); i.e., de-positioning of paper placed within paper supply apparatus(es) that might otherwise occur at the time of placement of paper within paper supply apparatus(es) and/or insertion of paper supply apparatus(es) into image forming apparatus(es).

Moreover, it is preferred that reinforcing plate(s) be circular plate(s) of diameter(s) larger than outside diameter(s) of pinion gear(s). Furthermore, reinforcing plate(s) may be such that member(s) separate from pinion gear(s) is/are fastened to bottom surface(s) (and/or top surface(s)) of pinion gear(s) by adhesive and/or other means, and/or reinforcing plate(s) may formed in integral fashion with respect to pinion gear(s).

In the paper supply apparatus of one or more embodiments of the present invention, it is preferred that diameter(s) of shaft(s) supporting pinion gear(s) be made large, and that a constitution be adopted such as will prevent deformation of shaft(s) despite receipt of impact(s) at pinion gear(s). Moreover, it is preferred that diameter(s) of shaft(s) of pinion gear(s) be not less than ⅓ of diameter(s) of pinion gear(s).

DETAILED DESCRIPTION OF THE INVENTION

Below, embodiments of the present invention are described with reference to the drawings.

First, referring to FIG. 11, the structure of a front-loading-type image forming apparatus employing a paper supply apparatus in accordance with the present invention will be described.

Figure 11:
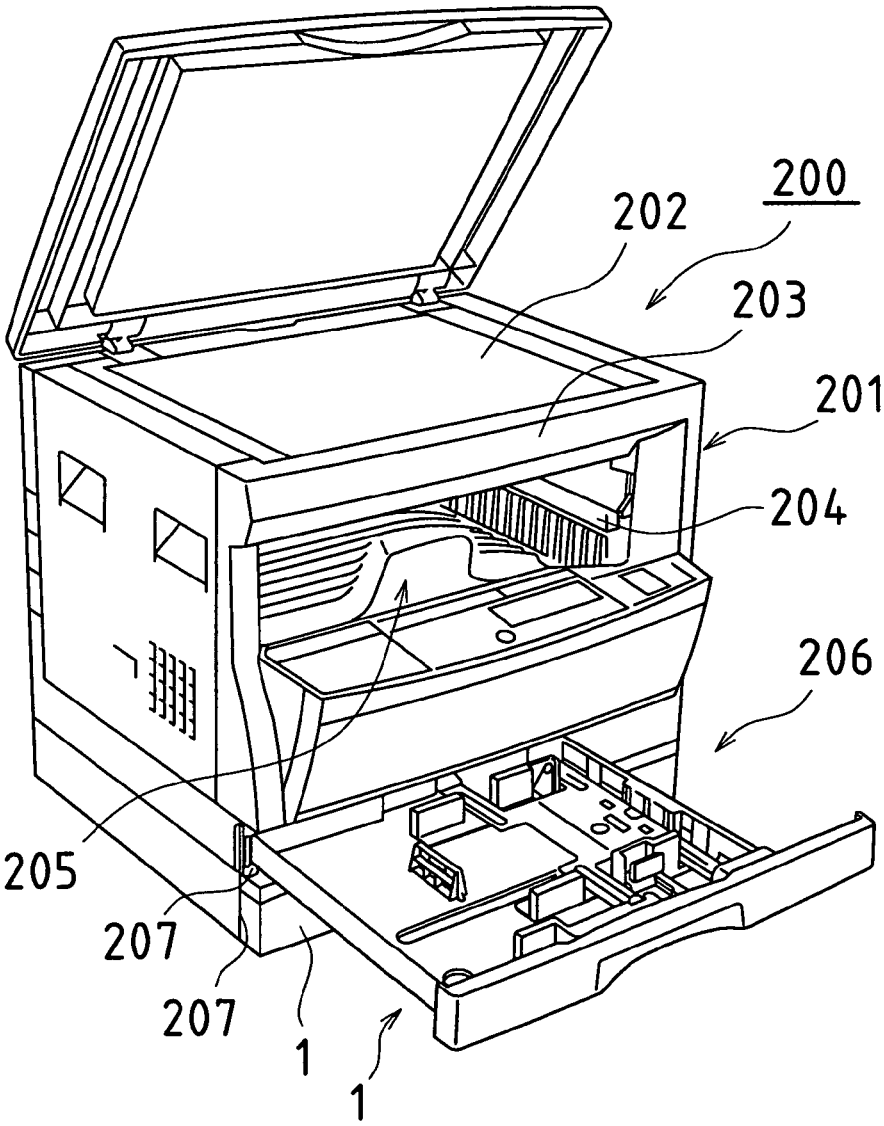
FIG. 11 is an oblique view showing the structure of an image forming apparatus employing a paper supply apparatus in accordance with the present invention.

Image forming apparatus 200 shown in FIG. 11 is such that original stage 202 comprising transparent glass body or bodies is installed at the top of vertically oriented apparatus main body 201, and scanning unit 203 for capturing image(s) of original(s) placed on this original stage 202 is provided beneath original stage 202. Image forming unit 204 is provided beneath scanning unit 203, in the region of the edge at one side (the region of the edge at the right side in FIG. 11) of apparatus main body 201; image data captured by scanning unit 203 being input at image forming unit 204, and copying of image(s) of original(s) onto paper surface(s) being carried out in accordance with electrophotographic image forming method(s) based on such image data. After image formation has been carried out thereon, the paper is discharged into discharge tray 205, which is installed centrally at the upper part of apparatus main body 201 (at a location beneath scanning unit 202).

Furthermore, at image forming apparatus 200 shown in FIG. 11, paper feed unit 206 is arranged in the region below discharge tray 205. Paper feed unit 206 is provided with two (upper and lower) cassette compartments 207, 207, a paper supply apparatus (paper feed cassette) 1 which is an embodiment of the present invention being loaded into each cassette compartment 207.

Paper supply apparatus 1 is loaded into cassette compartment 207 as result of being pushed from the near side of apparatus main body 201 toward the far side thereof, and paper contained within such paper supply apparatus 1 is taken up by a paper transport unit (not shown) in a direction perpendicular to the loading direction (direction in which cassette had been pushed thereinto) and is transported to the aforementioned image forming unit 204, where image(s) of original(s) is/are formed thereon.

Figure 1:
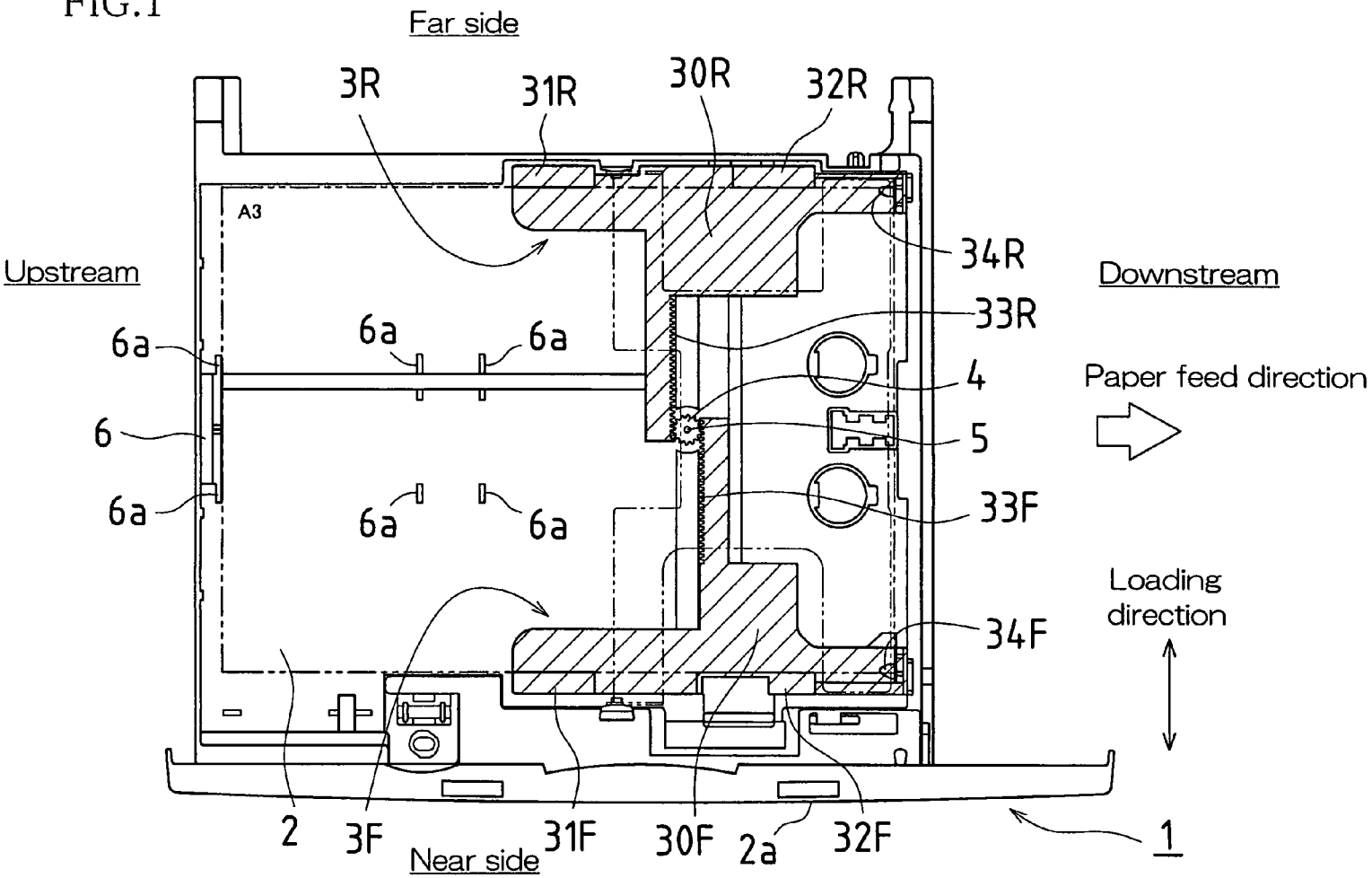
FIG. 1 is a plan view of an embodiment of the present invention.
Figure 2:
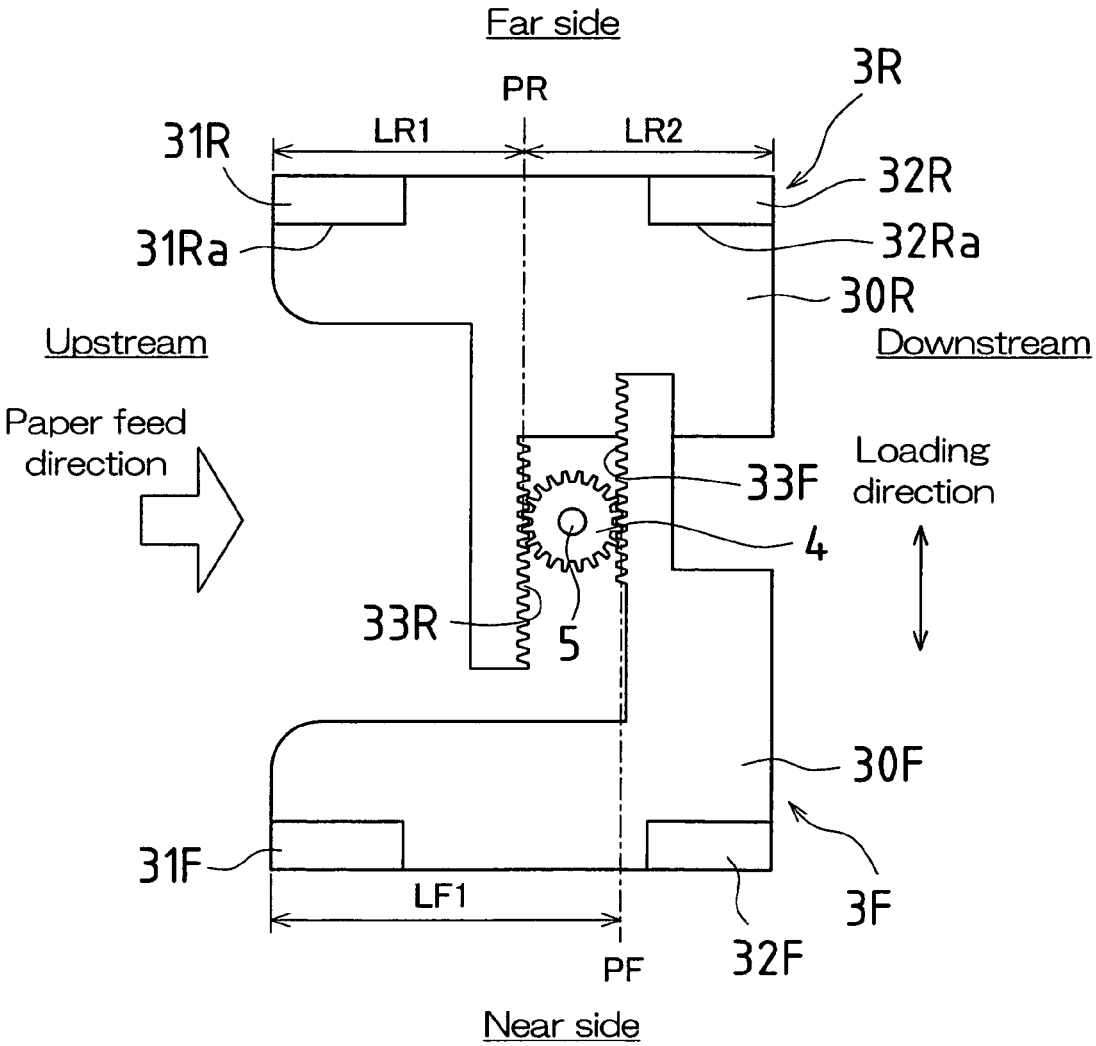
FIG. 2 is a drawing showing in schematic fashion the principal structural components of the embodiment of FIG. 1.

Next, referring to FIGS. 1 and 2, an embodiment of the paper supply apparatus of the present invention is described.

Paper supply apparatus 1 of the present embodiment, being what is generally referred to as a paper feed cassette, is loaded into a front-loading-type image forming apparatus 200 such as is shown in FIG. 11.

As shown in FIG. 1, paper supply apparatus 1 is equipped with supply apparatus main body 2 (hereinafter "paper feed cassette main body 2"), front surface 2*a* of that paper feed cassette main body 2 being attached to image forming apparatus 200 so as to be at the near side in the loading direction of image forming apparatus 200 (see FIG. 11). Furthermore, the paper feed direction is perpendicular to the loading direction, the upstream side of the paper feed direction corresponding to the left side of FIG. 1.

Figure 13:
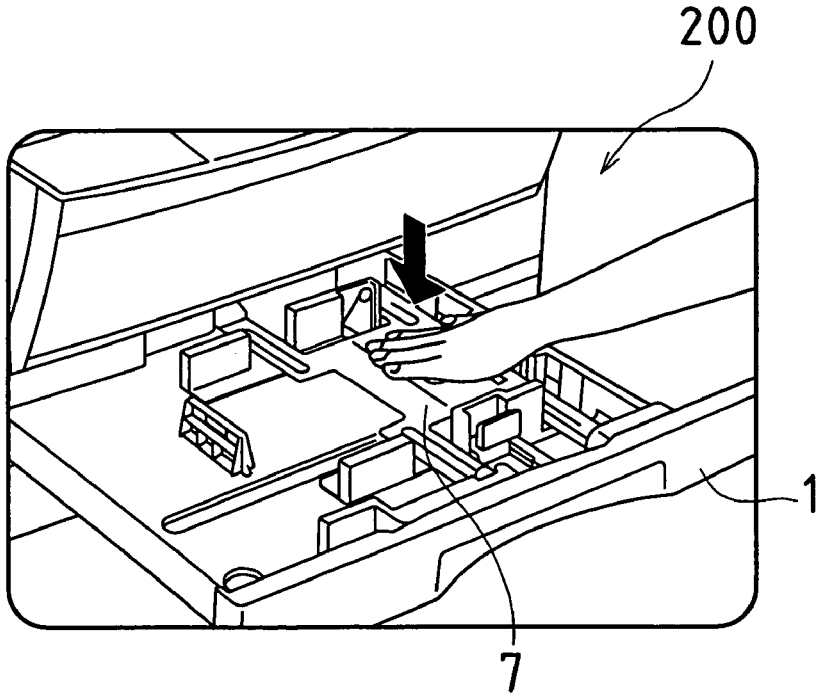
FIG. 13 is an explanatory diagram showing a procedure by which paper might be placed therein.

Arranged in opposing fashion at paper feed cassette main body 2 are paper guide 3F at the near side in the loading direction and paper guide 3R at the far side in the loading direction (the pair of members indicated by hatching at FIG. 1). Near-side paper guide 3F and far-side paper guide 3R are capable of moving in sliding fashion along rails (described in detail below) respectively extending in the loading direction, pinion gear 4 being arranged between these two paper guides 3F, 3R. Pinion gear 4 is rotatably installed on shaft 5 which protrudes upward from the base of paper feed cassette main body 2. Moreover, paper feed cassette main body 2 is provided with rotating plate 7 (see FIG. 13) for lifting upward the paper which has been placed thereon. Moreover, the base of paper feed cassette main body 2 is provided with a plurality of slit-like holes 6*a* for positioning and holding in place the paper trail edge plate(s) 6.

As shown in FIGS. 1 and 2, at near-side paper guide 3F, rack gear 33F extending in the loading direction is formed in integral fashion on baseplate 30F. Rack gear 33F is disposed downstream in the paper feed direction from pinion gear 4, meshing with pinion gear 4 at that location. Formed in integral fashion in the region of the end at the near side of baseplate 30F are upstream width guide plate 31F and downstream width guide plate 32F, which respectively rise in vertical fashion from baseplate 30F. In addition, integrally provided in the region at the end of the downstream side of near-side paper guide 3F is paper-separating tab 34F. Furthermore, near-side paper guide 3F is provided with position-locking stop 35F (see FIG. 14).

As shown in FIGS. 1 and 2, at far-side paper guide 3R, rack gear 33R extending in the loading direction is formed in integral fashion on baseplate 30R. Rack gear 33R is disposed upstream in the paper feed direction from pinion gear 4, meshing with pinion gear 4 at that location. Formed in integral fashion in the region of the end at the far side of baseplate 30R are upstream width guide plate 31R and downstream width guide plate 32R, which respectively rise in vertical fashion from baseplate 30R. In addition, integrally provided in the region at the end of the downstream side of far-side paper guide 3R is paper-separating tab 34R.

Moreover, in the present embodiment, near-side paper guide 3F, far-side paper guide 3R, near-side paper-separating tab 34F, far-side paper-separating tab 34R, rack gears 33F, 33R of respective paper guides 3F, 3R, and pinion gear 4 constitute a paper positioning mechanism (paper constraining mechanism).

Furthermore, the rack and pinion mechanism made up of rack gears 33F, 33R and pinion gear 4 causes near-side paper guide 3F (width guide plates 31F, 32F) and far-side paper guide 3R (width guide plates 31R, 32R) to engage in sliding motion in mutually linked and mutually oppositely directed fashion (in directions tending to cause mutual approach or recession), permitting a wide variety of sizes of paper such as, for example, A4, A3, B5, B4, and so forth, to be placed therebetween. Accordingly, because various sizes of paper may be held in place as a result of movement of the pair of paper guides 3F, 3R, paper of size(s) appropriate to the purpose of the user may be fed to image forming apparatus 200 shown in FIG. 11.

Figure 3:
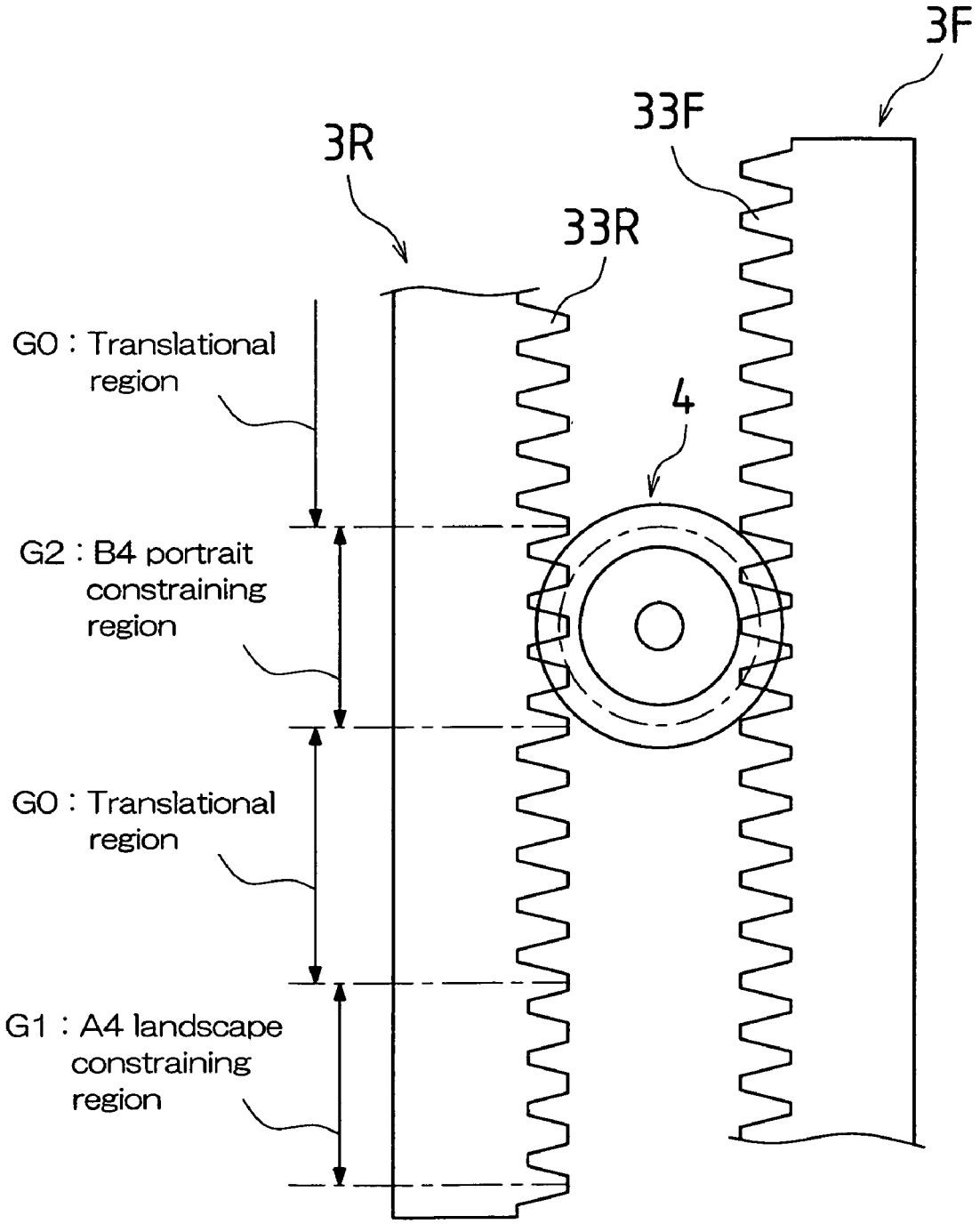
FIG. 3 is a plan view showing in schematic fashion the rack gear constitution that is a characteristic attribute of one or more embodiments of the present invention.
Figure 4:
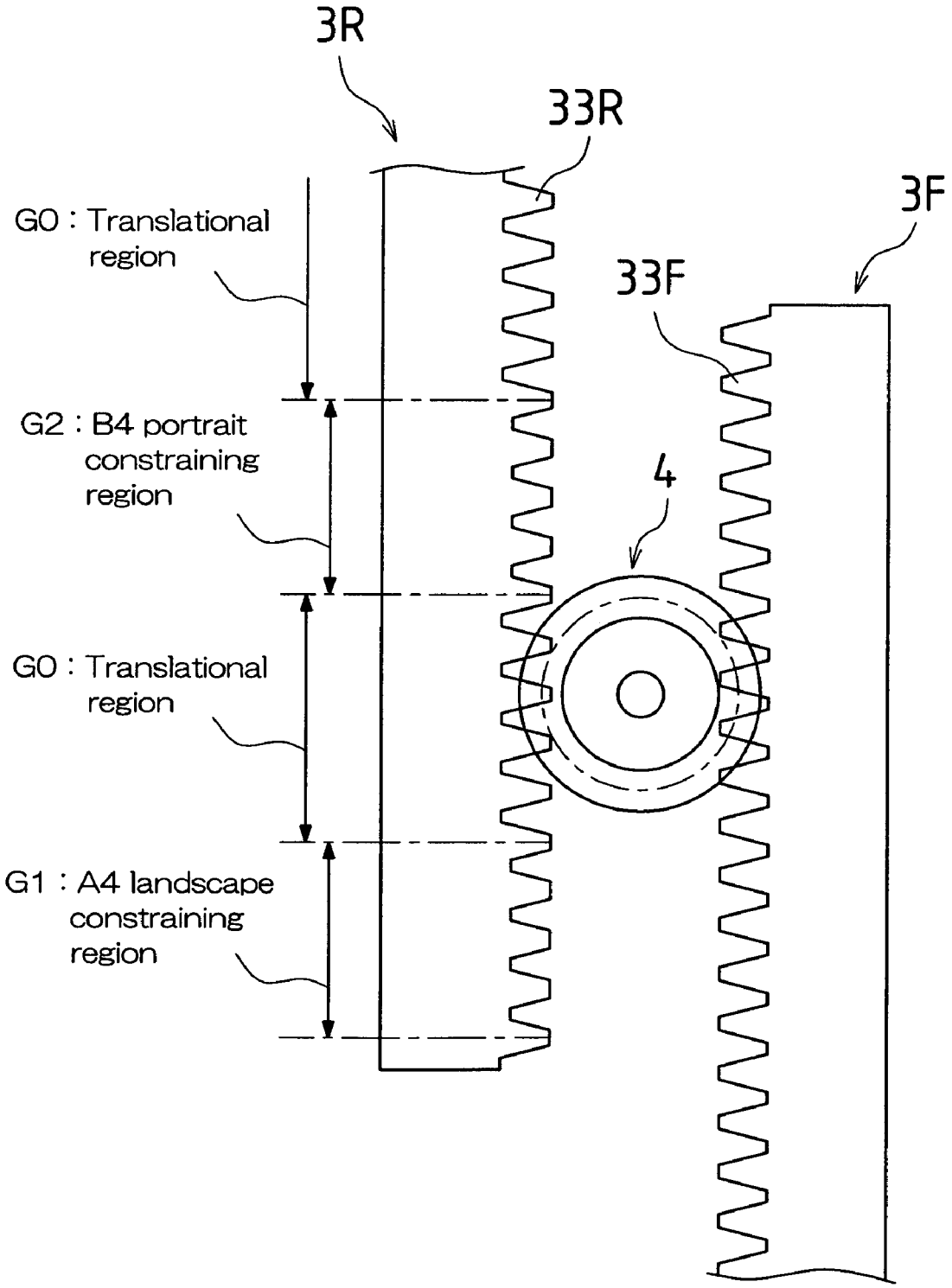
FIG. 4 is a plan view showing in schematic fashion the rack gear constitution therein.

Next, referring to FIGS. 3 and 4, the rack gear constitution of the present embodiment is described.

In this embodiment, the dimensions of the teeth of rack gear 33R of far-side paper guide 3R are made different at certain location(s).

More specifically, as shown in FIGS. 3 and 4, two regions (hereinafter "A4 landscape constraining region G1 and B4 portrait constraining region G2") are provided at specific locations in the loading direction (rack gear long direction) of rack gear 33R of far-side paper guide 3R, these locations corresponding to locations for constraining paper of standard size(s) (e.g., A4 landscape and B4 portrait), the manner in which pinion gear 4 is meshingly engaged by the teeth at this A4 landscape constraining region G1 and this B4 portrait constraining region G2 being tight, but the manner in which pinion gear 4 is meshingly engaged by the teeth at other region(s), i.e., translational region(s) G0, being loose.

As method for causing the manner of meshing at A4 landscape constraining region G1 and B4 portrait constraining region G2 to be tight, it is possible to employ a method in which, for example, the gear (multiple teeth) at respective constraining regions G1, G2 is formed with profile shift(s) (profile shift(s) in direction tending to decrease depth of inter-tooth space) relative to the reference line of the gear at translational region(s) G0. Moreover, in the present example, the manner in which pinion gear 4 is meshingly engaged by rack gear 33F of near-side paper guide 3F is substantially constant (no profile shift) over the entire length (dimension in the loading direction) thereof.

Moreover, the fact that rack gear 33R of far-side paper guide 3R is thus provided with A4 landscape constraining region G1 and B4 portrait constraining region G2 at which the manner in which pinion gear 4 is meshingly engaged is tight means that when paper guides 3F, 3R are at locations (FIG. 3) for constraining paper of standard size(s) (e.g., B4 portrait), B4 portrait constraining region G2 of rack gear 33R of far-side paper guide 3R will mesh with pinion gear 4, the manner of meshing being made tight thereat, with reduced backlash in the meshing between rack gear 33R and pinion gear 4, as a result of which there will be less mechanical play at far-side paper guide 3R. It is accordingly possible, despite occurrence of any force acting on far-side paper guide 3R due to impact during placement of paper within the paper feed cassette and/or insertion of the paper feed cassette into the image forming apparatus, to reduce de-positioning of far-side paper guide 3R and to prevent de-positioning of paper placed therein and/or paper transport problems that might otherwise occur in accompaniment thereto.

On the other hand, when paper guides 3F, 3R are at locations (FIG. 4) other than locations for constraining paper of standard size(s), i.e., when translational region(s) G0 of rack gear 33R of far-side paper guide 3R is/are meshingly engaged by pinion gear 4, because the manner of meshing between rack gear 33R and pinion gear 4 is loose, with increased backlash in the meshing therebetween, it will be possible to cause paper guides 3F, 3R to move with application of less force and it will be possible to cause operations which are carried out when moving paper guides 3F, 3R in sliding fashion, e.g., to locations for constraining paper or the like, to be accomplished smoothly.

Moreover, with respect to method(s) for preventing paper guide de-positioning (play), the present invention is not limited to the structure shown in FIGS. 3 and 4; it being possible, for example, to employ structure as shown in FIGS. 5(A) and (B).

Figure 5:
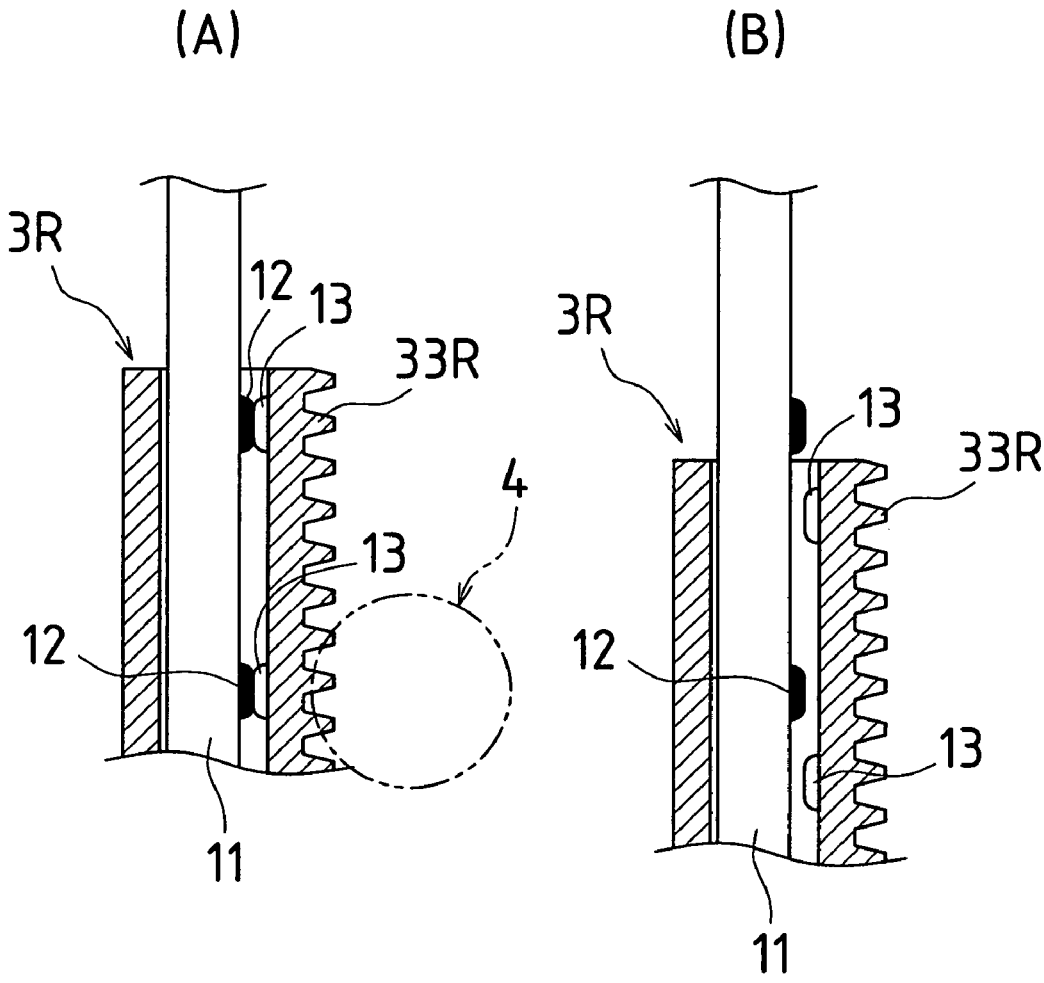
FIG. 5 contains drawings showing in schematic fashion the principal structural components of another embodiment of the present invention.
Figure 6:
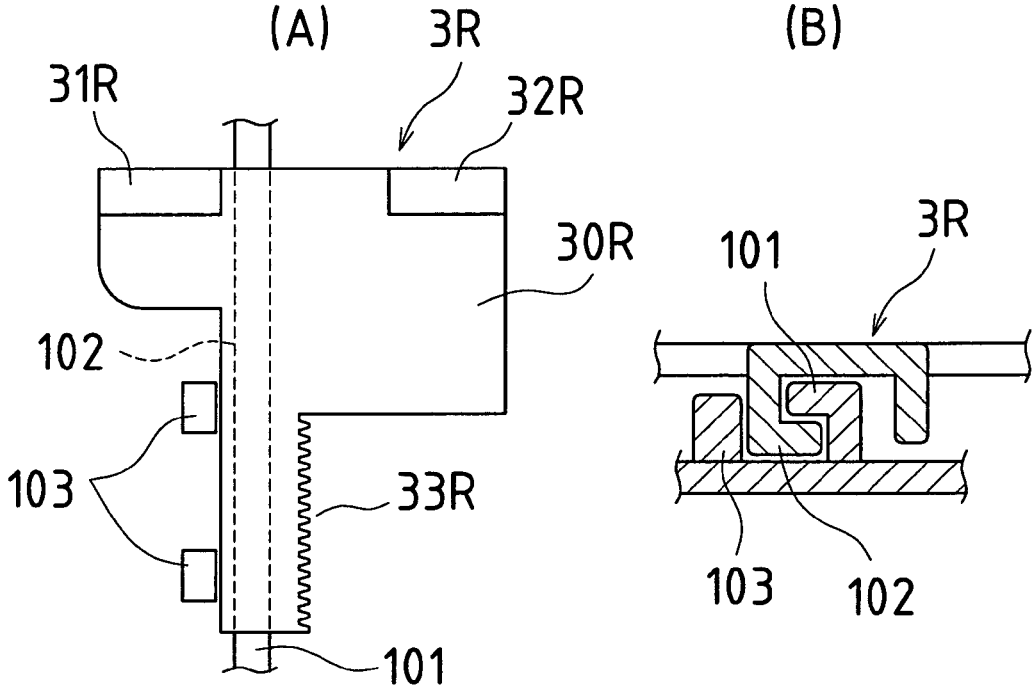
FIG. 6 contains (A) a plan view showing an example of structure for preventing deformation at paper guide(s), and (B) a vertical sectional view of principal components therein.

At the example shown in FIG. 5, rack gear 33R of far-side paper guide 3R is provided, at prescribed location(s) thereof in the loading direction, with projection(s) 13, 13 for pushing the teeth of rack gear 33R toward pinion gear 4. Furthermore, projection(s) 12, 12 are provided at prescribed location(s) along rail(s) 11 guiding far-side paper guide 3R.

Moreover, because the constitution in the present example is such that when far-side paper guide 3R is disposed at location(s) for constraining paper of standard size(s) as shown at FIG. 5(A), projection(s) 12 on rail(s) 11 at paper feed cassette main body 2 come in contact with projection(s) 13 at the back surface of rack gear 33R of far-side paper guide 3R, pushing the teeth of rack gear 33R at such contacting portion(s) toward pinion gear 4, causing the manner of meshing between rack gear 33R and pinion gear 4 to become tight, and reducing backlash in the meshing between rack gear 33R and pinion gear 4, there is less mechanical play at far-side paper guide 3R when at location(s) for constraining paper. It is accordingly possible, despite occurrence of any force acting on far-side paper guide 3R due to impact during placement of paper within the paper feed cassette and/or insertion of the paper feed cassette into the image forming apparatus, to reduce de-positioning of far-side paper guide 3R and to prevent de-positioning of paper placed therein and/or paper transport problems that might otherwise occur in accompaniment thereto.

On the other hand, because when far-side paper guide 3R is, as shown in FIG. 5(B), at location(s) other than location(s) for constraining paper of standard size(s), projection(s) 12 on rail(s) 11 do not come in contact with projection(s) 13 at rack gear 33R and the manner of meshing between rack gear 33R and pinion gear 4 is returned to its normal state (manner of meshing is loose), with increased backlash in the meshing therebetween, it will be possible to cause paper guides 3F, 3R to move with application of less force and it will be possible to cause operations which are carried out when moving paper guides 3F, 3R in sliding fashion, e.g., to locations for constraining paper or the like, to he accomplished smoothly.

Next, referring to FIG. 2, such attributes as the positional relationship of the paper guides, these being other aspects of the present embodiment, are described.

Far-Side Paper Guide

At far-side paper guide 3R, the area of paper-receiving surface 31Ra of upstream width guide plate 31R that receives the paper is made to be more or less equal to the area of paper-receiving surface 32Ra of downstream width guide plate 32R that receives the paper. Furthermore, distance (distance in paper feed direction) LR1 between the upstream end of upstream width guide plate 31R and gear mesh location (location at which rack gear 33R and pinion gear 4 meshingly engage) PR is made to be more or less equal to distance (distance in paper feed direction) LR2 between the downstream end of downstream width guide plate 32R and gear mesh location PR (LR1=LR2).

Relationship Between Near- and Far-Side Paper Guides

By disposing rack gear 33R of far-side paper guide 3R upstream in the paper feed direction from pinion gear 4 and by disposing rack gear 33F of near-side paper guide 3F downstream in the paper feed direction from pinion gear 4, distance (distance in paper feed direction) LR1 between the upstream end of upstream width guide plate 31R of far-side paper guide 3R and gear mesh location PR is made to be shorter than distance (distance in paper feed direction) LF1 between the upstream end of upstream width guide plate 31F of near-side paper guide 3F and gear mesh location (location at which rack gear 33F and pinion gear 4 meshingly engage) PF (LR1<LF1).

Figure 17:
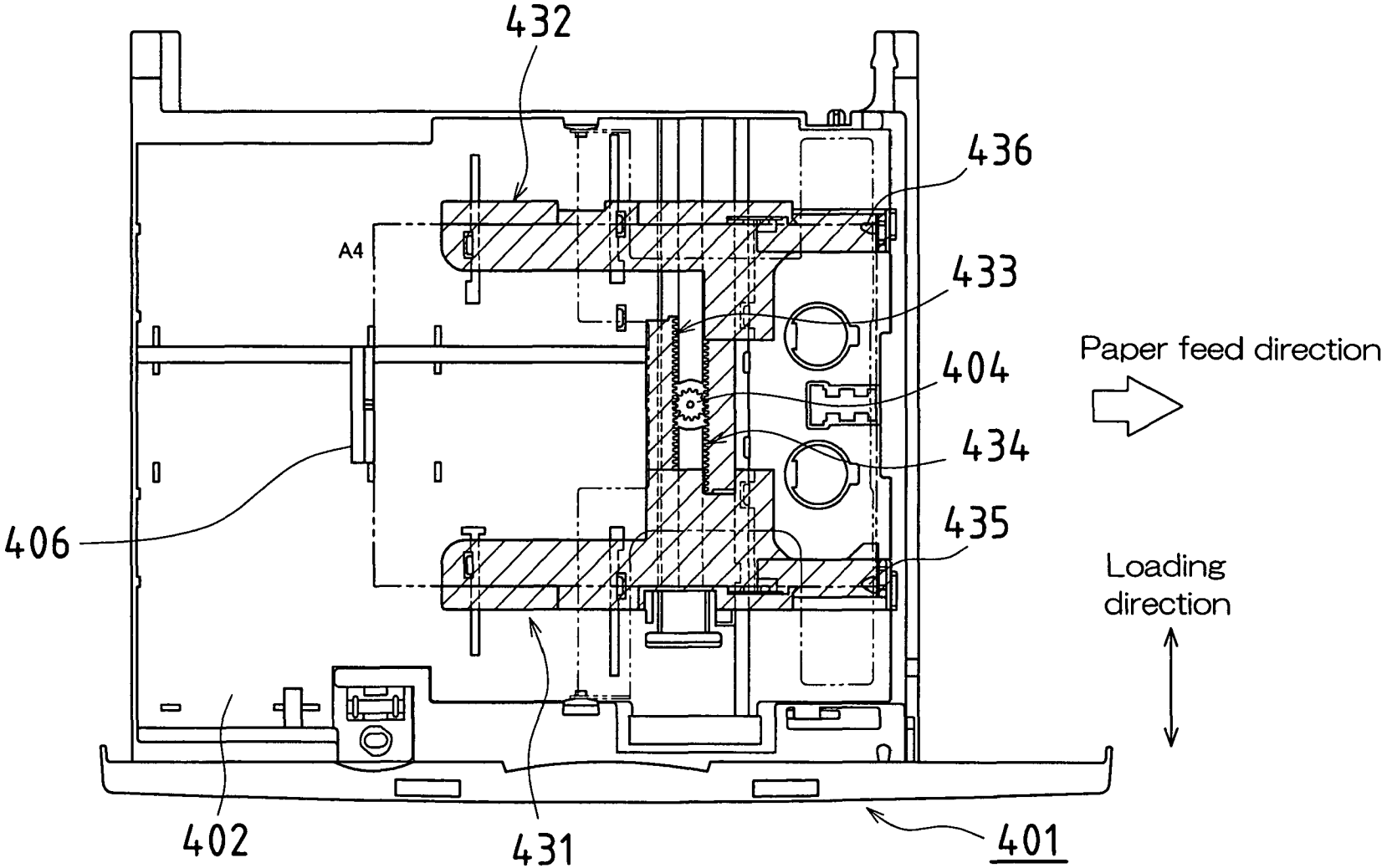
FIG.17 Prior Art
FIG. 17 is a plan view showing a conventional paper feed cassette capable of being used in a front-loading-type image forming apparatus.
Figure 18:
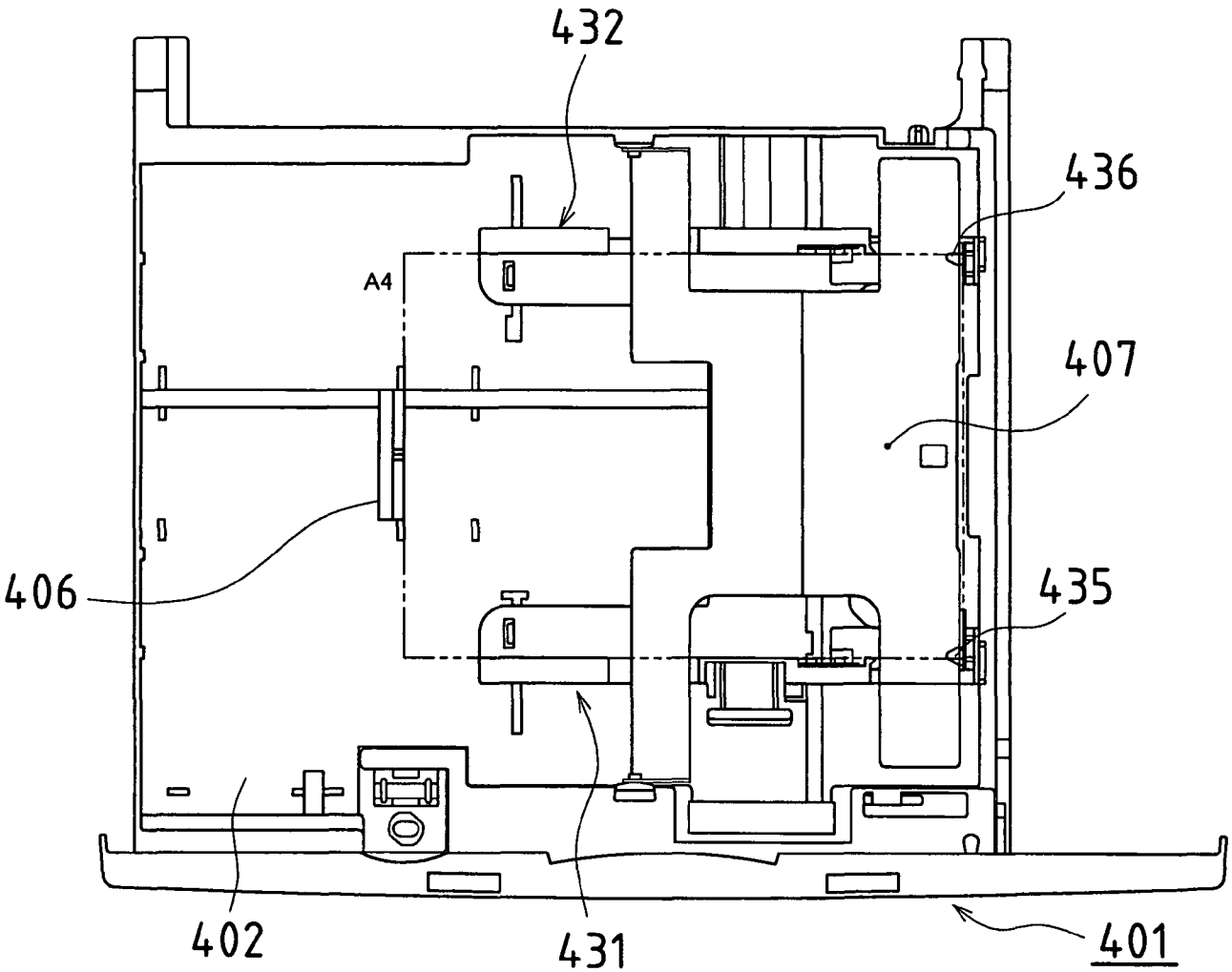
FIG.18 Prior Art
FIG. 18 is a plan view of the paper feed cassette therein.

In paper supply apparatus 1 of the present embodiment as described above, because rack gear 33R of far-side paper guide 3R is disposed upstream in the paper feed direction from pinion gear 4 (downstream from the pinion gear in the conventional paper feed cassette shown in FIG. 17), because upstream width guide plate 31R and downstream width guide plate 32R of far-side paper guide 3R are moreover constituted such that areas of respective paper-receiving surfaces 31Ra, 32Ra are made more or less mutually equal, and because distance LR1 between the upstream end of upstream width guide plate 31R and gear mesh location PR and distance LR2 between the downstream end of downstream width guide plate 32R and gear mesh location PR are made more or less mutually equal, impact(s) produced by stack(s) of paper during placement of paper within paper supply apparatus 1 and/ or insertion of paper supply apparatus 1 into image forming apparatus 200 can be received more or less equally upstream and downstream in the paper feed direction from far-side paper guide 3R (upstream and downstream from location PR at which rack gear 33R is meshingly engaged), and torques acting on far-side paper guide 3R upstream and downstream from gear mesh location PR can be made more or less mutually equal. As a result, deformation of far-side paper guide 3R can be prevented, and it is possible to prevent de-positioning of paper placed therein and/or paper transport problems that might otherwise occur in accompaniment thereto.

In addition, because distance LR1 between the upstream end of upstream width guide plate 31R of far-side paper guide 3R and gear mesh location PR is made to be shorter than distance LF1 between the upstream end of upstream width guide plate 31F of near-side paper guide 3F and gear mesh location PF (LR1<LF1), torque(s) acting on far-side paper guide 3R due to force(s) from impact(s) during placement of paper within paper supply apparatus 1 and/or insertion of paper supply apparatus 1 into image forming apparatus 200 can be lessened, and it is possible to reduce the load on far-side paper guide 3R.

Here, if the relationship between far-side paper guide 3R and near-side paper guide 3F is made to be as indicated by the arrangement shown in FIG. 2, while it is true that this would cause near-side paper guide 3F to experience disadvantageous conditions relative to force due to impact, because the force due to impact which is exerted on near-side paper guide 3F is less than that which is exerted on far-side paper guide 3R, existence of such disadvantageous conditions at near-side paper guide 3F pose no particular problem.

Furthermore, it is preferred that paper guide 3F and paper guide 3R be made to have identical dimensions. Making the dimensions thereof identical will permit reduction in manufacturing cost. Furthermore, for the purpose of causing paper guide 3F and paper guide 3R to have identical dimensions as described above, it is preferred that rack gears 33F, 33R be formed so as to be located at the approximate centers of paper guides 3F, 3R in the paper feed direction.

Note also that whereas the structure shown in FIG. 2 is such that at far-side paper guide 3R the area of paper-receiving surface 31Ra of upstream width guide plate 31R is made more or less equal to the area of paper-receiving surface 32Ra of downstream width guide plate 32R, even where the areas of this paper-receiving surface 31Ra and this paper-receiving surface 32Ra are mutually different it is possible, by adopting a constitution in which the product of the area of paper-receiving surface 31Ra of upstream width guide plate 31R and the distance from the center of this paper-receiving surface 31Ra to gear mesh location PR is made more or less equal to the product of the area of paper-receiving surface 32Ra of downstream width guide plate 32F and the distance from the center of this paper-receiving surface 32Ra to gear mesh location PR, to cause torques acting on far-side paper guide 3R upstream and downstream from gear mesh location PR to be made more or less mutually equal.

Next, referring to FIGS. 6 through 10, other attributes of the present embodiment are described.

In the present embodiment, because, as described above, the manner of meshing between rack gear 33R of far-side paper guide 3R and pinion gear 4 is made tight when at location(s) for constraining paper of standard size(s), load(s) is/are exerted on rack gear 33R during placement of paper within the paper supply apparatus and/or insertion of the paper supply apparatus into the image forming apparatus. In light of this fact, means are provided for preventing deformation of various components. Specific structure for accomplishing same is described in detail below.

Preventing Deformation of Paper Guide

As one means for preventing deformation, a method may be adopted in which the dimensions of rail(s) 11 guiding paper guide(s) in the loading direction are improved.

More specifically, as shown at FIGS. 6(A) and (B), rail(s) 101 provided at paper feed cassette main body 2 may be given inverted-L-shaped (hook-shaped) cross-section(s), and far-side paper guide 3R may be provided with mating member(s) 102 having L-shaped cross-section(s) mating with such rail (s) 101. Adoption of such structure makes it possible to prevent warpage and/or deformation of region(s) of far-side paper guide 3R at which baseplate 30R and rack gear 33R are formed and makes it possible to reduce deformation (inclination) of width guide plates 31R, 32R.

Moreover, by, as shown at FIGS. 6(A) and (B), providing derail preventing member(s) 103 for preventing mating member(s) 102 of far-side paper guide 3R from separating from rail(s) 101, it will be possible to more definitively prevent warpage and/or deformation of baseplate 30R of far-side paper guide 3R.

Moreover, the respective cross-sectional shapes of rail(s) 101 and mating member(s) 102 are not limited to being L-shaped, it being possible, for example, to employ T-shaped cross-sectional shape and/or any other arbitrary mutually mating cross-sectional shape(s). Furthermore, instead of a constitution employing mating member(s) 102, guide channel(s) of dimensions permitting mating with rail(s) 101 of L-shaped cross-section, e.g., guide channel(s) having L-shaped, T-shaped, and/or other such cross-sectional shape, may be formed at the underside of far-side paper guide 3R.

Figure 7:
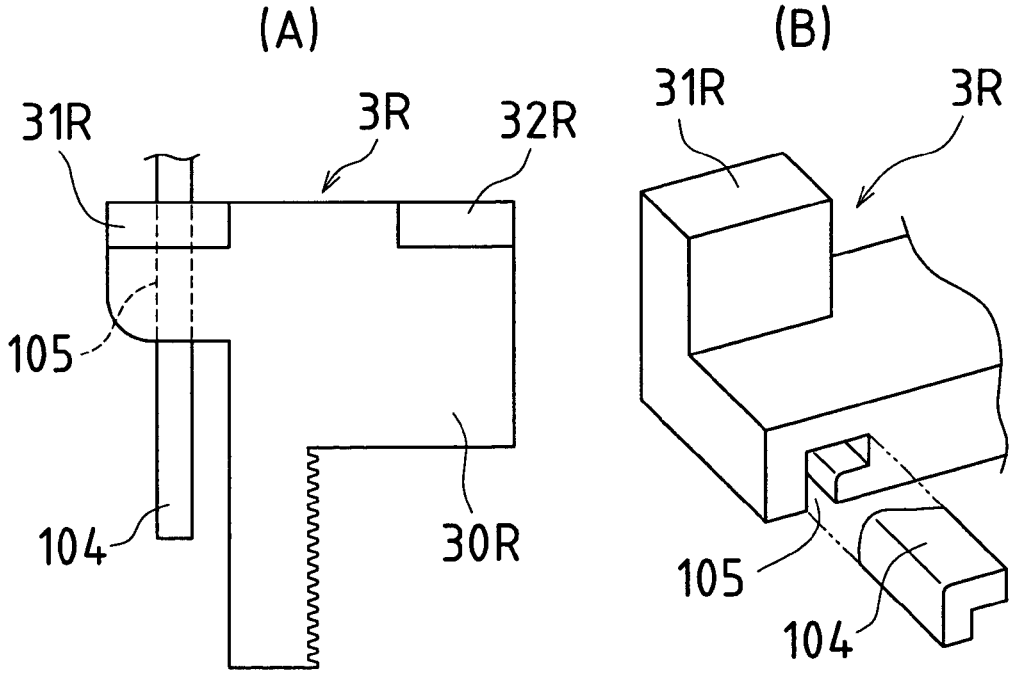
FIG. 7 contains (A) a plan view showing another example of structure for preventing deformation at paper guide(s), and (B) an oblique view of principal components therein.

Furthermore, by, as shown at FIGS. 7(A) and (B), adopting a constitution for preventing warpage and/or deformation of the region at which width guide plate 31R of far-side paper guide 3R is formed through provision of auxiliary rail(s) 104 having inverted-L-shaped cross-section(s) at location(s) corresponding to region(s) below width guide plate 31R and through provision of paper guide 3R with L-shaped guide channel(s) 105 permitting mating with such auxiliary rail(s) 104, it will be possible to still more definitively prevent inclination of width guide plate 31R. Note that structure for preventing deformation such as was indicated at the foregoing FIGS. 6 and 7 (rail(s) and/or other such structure) may alternatively or additionally be provided at near-side paper guide 3F.

Figure 8:
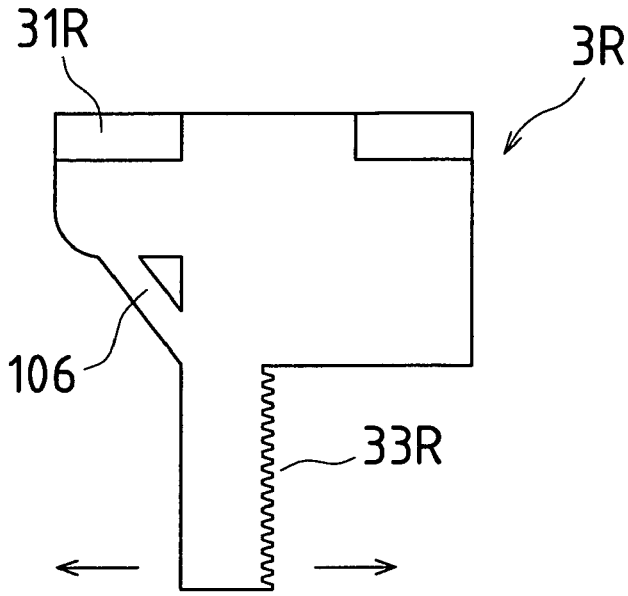
FIG. 8 is a plan view showing a different example of structure for preventing deformation at paper guide(s).

Moreover, at far-side paper guide 3R, the region at which rack gear 33R is formed and a region upstream from a location in the vicinity of paper guide 3R may be tied together by means of torsion-preventing member(s) 106 as shown in FIG. 8, strengthening the region at which rack gear 33R is formed, so as to prevent deformation of rack gear 33R relative to far-side paper guide 3R (deformation in the direction indicated by arrows in the drawing). Note that torsion-preventing member(s) 106 may be formed in integral fashion with respect to far-side paper guide 3R as shown in FIG. 8, and/or separately manufactured torsion-preventing member(s) may be attached to the paper guide.

Preventing Deformation of Pinion Gear

In the present embodiment, measures for preventing deformation may also be adopted at pinion gear 4, which receives impact(s) due to warpage of rack gear 33R (33F) and so forth.

Figure 9:
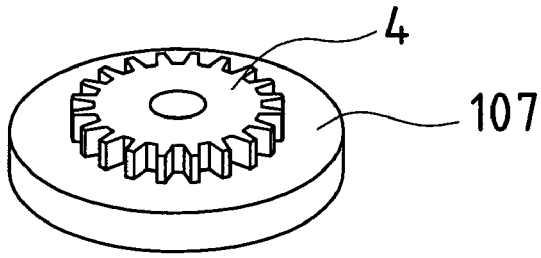
FIG. 9 is an oblique view showing an example of structure for strengthening pinion gear(s).

More specifically, as shown in FIG. 9, reinforcing plate(s) 107 may be provided at the underside of pinion gear 4. Reinforcing plate 107 is a circular plate of diameter larger than the outside diameter of pinion gear 4, and is fastened to the bottom of pinion gear 4 by adhesive or other means.

By thus reinforcing and increasing the strength of pinion gear 4 by means of reinforcing plate 107, it is possible to reduce deformation of pinion gear 4 despite action of large force(s) on pinion gear 4 during placement of paper within paper supply apparatus 1 and/or insertion of paper supply apparatus 1 into image forming apparatus 200. This makes it possible to prevent problems that might otherwise occur due to deformation of pinion gear 4; i.e., de-positioning of paper placed within paper supply apparatus 1 that might otherwise occur at the time of placement of paper within paper supply apparatus 1 and/or insertion of paper supply apparatus 1 into image forming apparatus 200.

Figure 10:
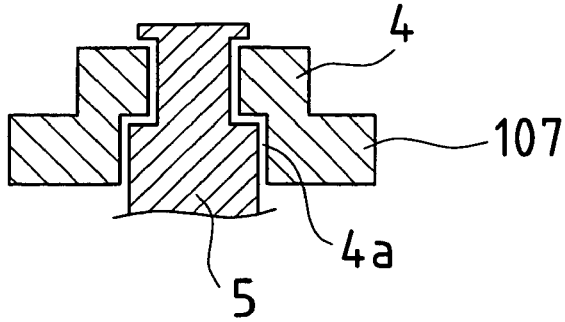
FIG. 10 is a vertical sectional view showing an example of structure for strengthening pinion gear shaft(s).

Furthermore, as shown in FIG. 10, in the present embodiment, by increasing the diameter of shaft 5 supporting pinion gear. 4 it is possible to prevent problem(s) that might otherwise occur due to deformation of shaft 5; i.e., problems that might otherwise occur in which deformation of shaft 5 of pinion gear 4 causes de-positioning of pinion gear 4, and paper guides 3F, 3R are likewise de-positioned.

Moreover, it is preferred that the diameter of shaft 5 be not less than ⅓ of the diameter of pinion gear 4. Furthermore, because increasing the diameter of shaft 5 could cause occurrence of a problem in which there is reduced strength due to the increased size of bushing 4*a* for pinion gear 4, it is preferred that reinforcing plate 107 be provided beneath pinion gear 4 so as to ensure that there is adequate strength at pinion gear 4. Moreover, reinforcing plate 107 shown in FIGS. 9 and 10 may be formed in integral fashion with respect to pinion gear 4.

Paper supply apparatus 1 of the present embodiment, described above, is used by loading same into paper feed unit 206 (cassette compartment 207) of image forming apparatus 200 shown in FIG. 11. Referring to FIGS. 12 through 16, a procedure by which paper might be placed therein during use thereof will be described.

Figure 12:
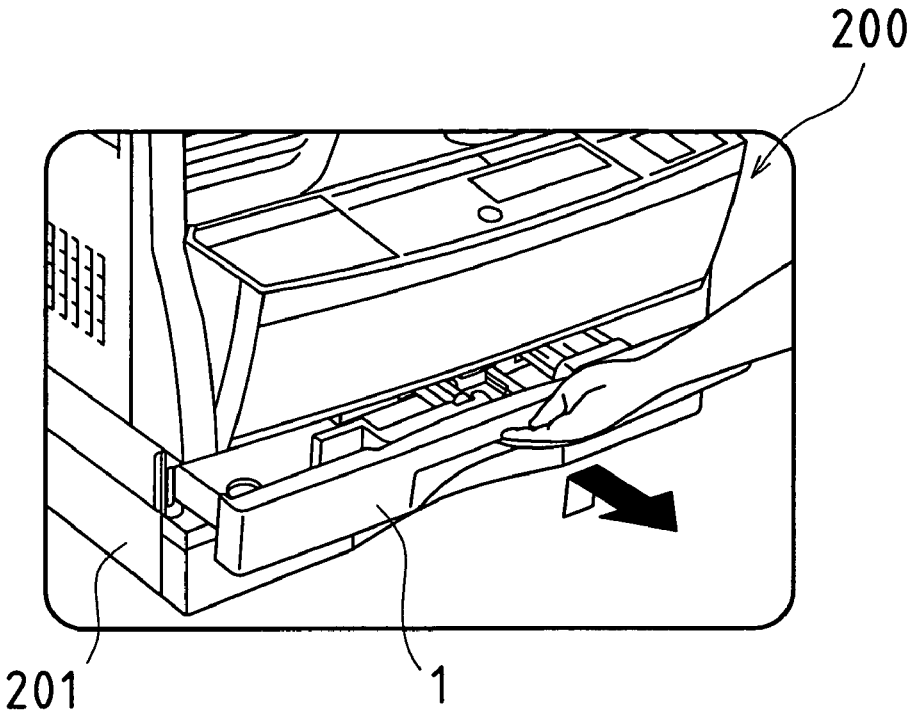
FIG. 12 is an explanatory diagram showing a procedure by which paper might be placed in an image forming apparatus.

(1) As shown in FIG. 12, paper supply apparatus 1 is first pulled out from apparatus main body 201 of image forming apparatus 200 to the near side thereof. In the event that no paper is present within paper supply apparatus 1 which has been pulled out therefrom (FIG. 13), because rotating plate 7 will be in its upward state, rotating plate 7 is pressed downward.

Figure 14:
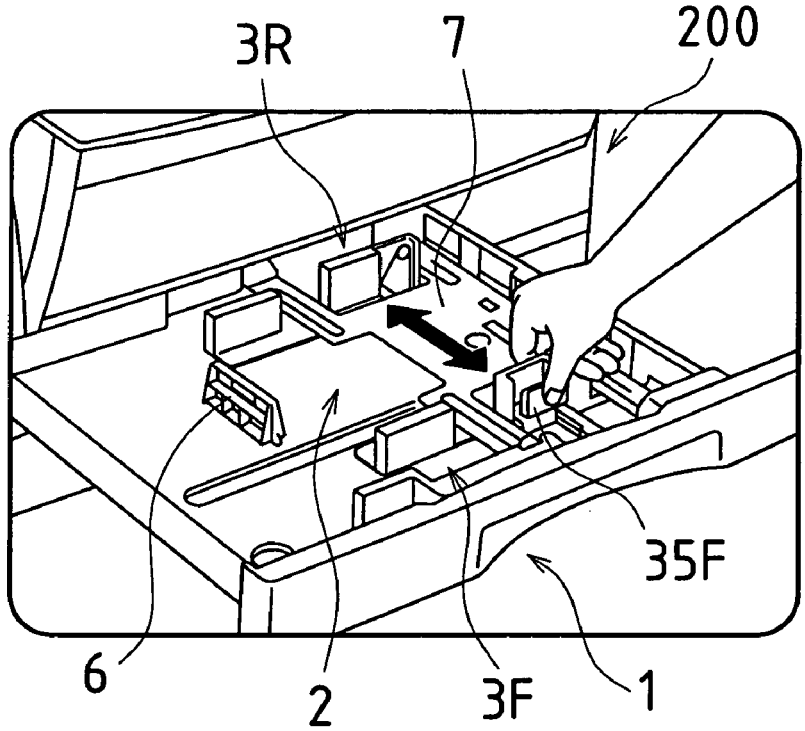
FIG. 14 is an explanatory diagram showing a procedure by which paper might be placed therein.

(2) As shown in FIG. 14, with position locking tab 35F of near-side paper guide 3F released, near-side paper guide 3F is moved in sliding fashion until near-side paper guide 3F assumes a location that will accommodate the size of the paper which will be placed therein. In accompaniment to this sliding motion of near-side paper guide 3F, far-side paper guide 3R will also move in sliding fashion. More specifically, when near-side paper guide 3F is moved in sliding fashion, this causes pinion gear 4, which meshes with rack gear 33F of this near-side paper guide 3F, to rotate, rotation of this pinion gear 4 driving rack gear 33R of far-side paper guide 3R and causing far-side paper guide 3R to move in sliding fashion.

(3) The location of paper trail edge plate 6 is adjusted to accommodate the size of the paper (FIG. 14). This paper trail edge plate 6 can be moved independent of near-side paper guide 3F and far-side paper guide 3R.

Figure 15:
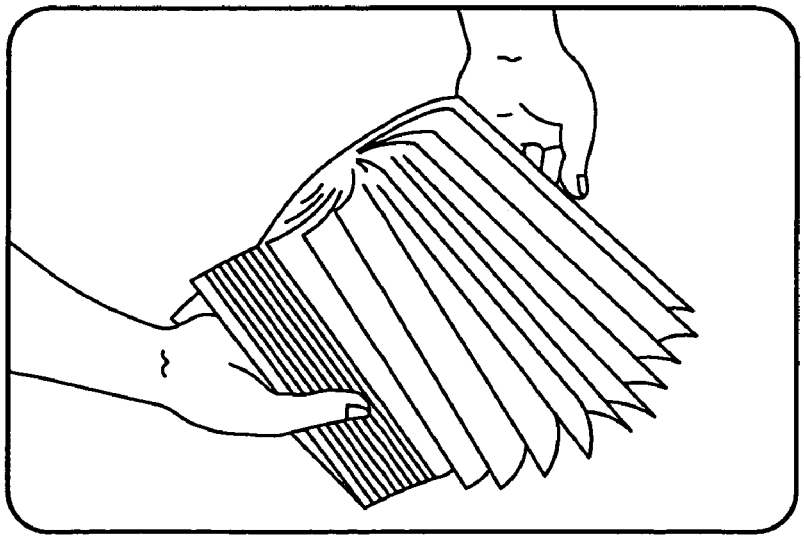
FIG. 15 is an explanatory diagram showing a procedure by which paper might be placed therein.
Figure 16:
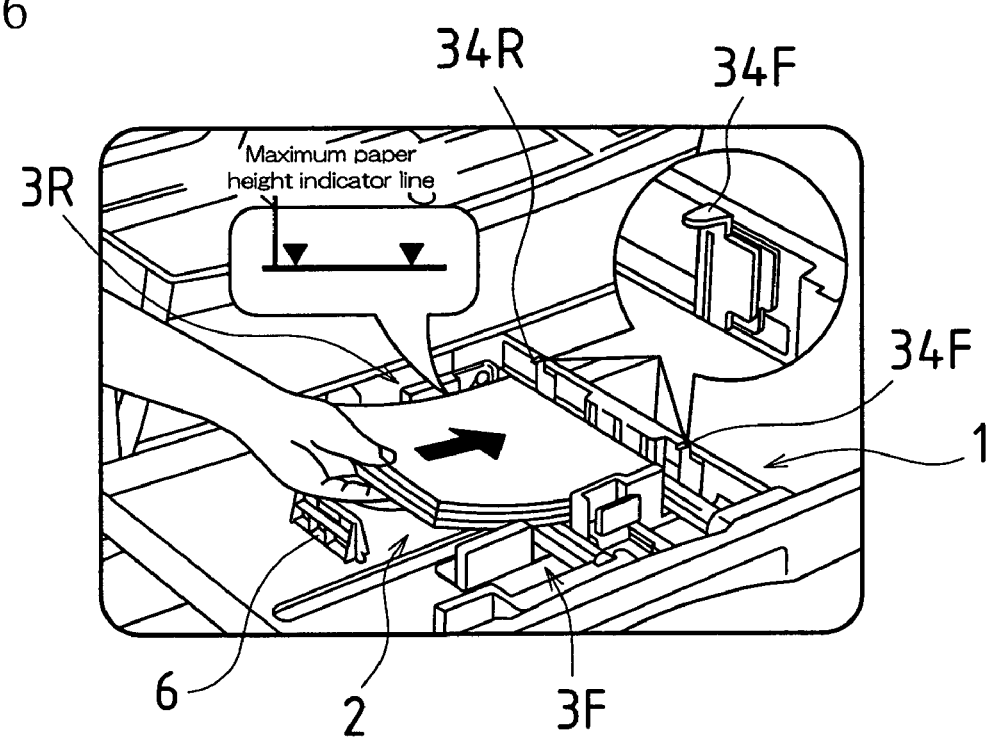
FIG. 16 is an explanatory diagram showing a procedure by which paper might be placed therein.

(4) As shown in FIG. 15, the paper is fanned to facilitate separation thereof. Next, as shown in FIG. 16, the paper is placed within paper feed cassette main body 2 of paper supply apparatus 1. At such time, in placing the paper therein, the paper is made to lie beneath paper-separating tabs 34F, 34R. Furthermore, the quantity of paper placed therein is adjusted so as to be below the "maximum paper height indicator line." Moreover, paper supply apparatus 1, paper having been placed therein, is pushed into image forming apparatus 200. In this way, it is possible to accomplish filling of paper.

As described above, in paper supply apparatus(es) in accordance with embodiment(s) of the present invention, because rack gear(s) of far-side paper guide(s) is/are such that manner (s) of meshing with pinion gear(s) is/are made tight at specific region(s) corresponding to location(s) for constraining paper of standard size(s) capable of being contained within paper supply apparatus(es), manner(s) of meshing therewith being made loose elsewhere, it is possible to reduce de-positioning (play) of paper guide(s) despite action on far-side paper guide (s) of impact(s) from stack(s) of paper produced during placement of paper within paper supply apparatus(es) and/or insertion of paper supply apparatus(es) into image forming apparatus(es). As a result, it is possible to prevent de-positioning of paper placed therein at image forming apparatus (es) and/or paper transport problems that might otherwise occur in accompaniment thereto.

Furthermore, in paper supply apparatus(es) in accordance with embodiment(s) of the present invention, by, for example, constituting width guide plate(s) which is/are upstream in paper feed direction(s) from far-side paper guide(s) and width guide plate(s) which is/are downstream in paper feed direction(s) therefrom such that areas of surfaces receiving paper, and distances from respective width guide plates to gear mesh location(s) (location(s) at which rack gear(s) and pinion gear (s) are meshingly engaged), are respectively set so as to be more or less mutually equal, impact(s) from stack(s) of paper produced during placement of paper within paper supply apparatus(es) and/or insertion of paper supply apparatus(es) into image forming apparatus(es) can be received more or less equally upstream and downstream from gear mesh location (s) of far-side paper guide(s), as a result of which torques acting on far-side paper guide(s) upstream and downstream from gear mesh location(s) can be made more or less mutually equal, making it possible to prevent deformation of far-side paper guide(s). As a result, it is possible to prevent de-positioning of paper placed therein at image forming apparatus (es) and/or paper transport problems that might otherwise occur in accompaniment thereto.

Moreover, the present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are moreover within the scope of the present invention.

What is claimed is:

1. A paper supply apparatus capable of being loaded into a front-loading-type image forming apparatus and permitting placement of paper therein as a result of removal/insertion operations carried out at a near side of the image forming apparatus, the paper supply apparatus comprising:

a near-side paper guide and a far-side paper guide respectively arranged so as to oppose one another, each having a rack gear extending in a direction substantially parallel to a loading direction; and a pinion gear respectively meshing with the rack gear of the near-side paper guide and the rack gear of the far-side paper guide, the pinion gear being at least one circular pinion gear having a constant pitch;

wherein a paper feed direction is substantially perpendicular to the loading direction; and the rack gear of the far-side paper guide is provided, at a specific location thereof in the loading direction, with a region at which a manner of meshing between the pinion gear and the rack gear of the far-side paper guide is different from a manner of meshing therebetween at another portion thereof.

2. A paper supply apparatus according to claim 1 wherein the region at which a manner of meshing with the pinion gear is different is a region corresponding to a location for constraining a standard size of paper capable of being contained within the paper supply apparatus;

the manner of meshing at the specific region is tight; and the manner of meshing at the different portion is loose.

3. A paper supply apparatus according to claim 1 wherein the region at which manner of meshing with the pinion gear is different is a plurality of regions corresponding to respective locations for constraining a plurality of standard sizes of paper capable of being contained within the paper supply apparatus;

the manner of meshing at the plurality of specific regions is tight; and the manner of meshing at the different portion is loose.

4. A paper supply apparatus according to claim 1 wherein the region at which the manner of meshing with the pinion gear is different is formed by means of a profile shift at either the rack gear of the far-side paper guide or the rack gear of the near-side paper guide.

5. A paper supply apparatus capable of being loaded into a front-loading-type image forming apparatus and permitting placement of paper therein as a result of removal/insertion operations carried out at a near side of the image forming apparatus, the paper supply apparatus comprising:

a near-side paper guide and a far-side paper guide respectively arranged so as to oppose one another, each having a rack gear extending in a direction substantially parallel to a loading direction; and a pinion gear respectively meshing with a rack gear of the near-side paper guide and a rack gear of the far-side paper guide;

wherein a paper feed direction is substantially perpendicular to the loading direction;

the rack gear of the far-side paper guide is provided, at a prescribed location thereof in the loading direction, with a plurality of first projections for pushing a tooth of the rack gear at that portion thereof toward the pinion gear;

the paper supply apparatus is provided with a rail member that slidably supports the far-side paper guide, the rail member is provided with a plurality of second projections capable of pressing on the plurality of first projections; and the paper supply apparatus is constituted such that when the far-side paper guide is disposed at a location for constraining one or more standard sizes of paper capable of being contained within the paper supply apparatus, the plurality of second projections comes in contact with the plurality of first projections, causing a manner in which the rack gear of the far-side paper guide is pushed toward the pinion gear so as to tighten meshing of the rack gear of the far-side paper guide with the pinion gear.

6. The paper supply apparatus according to claim 5, wherein the rack gear of the far-side paper guide has teeth including different dimensions at different locations along the rack gear of the far-side paper guide.

7. A paper supply apparatus capable of being loaded into a front-loading-type image forming apparatus and permitting placement of paper therein as a result of removal/insertion operations carried out at a near side of the image forming apparatus, the paper supply apparatus comprising:

a near-side paper guide and a far-side paper guide respectively arranged so as to oppose one another, each having at least one width guide plate for constraining a portion of the paper and a rack gear extending in a direction substantially parallel to a loading direction; and a pinion gear respectively meshing with the rack gear of the near-side paper guide and the rack gear of the far-side paper guide;

wherein a paper feed direction is substantially perpendicular to the loading direction, the far-side paper guide is constituted such that, with respect to a gear mesh location at which the pinion gear and the far-side paper guide rack gear mutually mesh, a product of an area of a surface of the width guide plate of the far-side paper guide that receives a portion of the paper and that is upstream, being located upstream in the paper feed direction, and a distance from a center of the upstream paper-receiving surface to the gear mesh location is substantially equal to a product of an area of a surface of the width guide plate of the far-side paper guide that receives a portion of the paper and that is downstream, being located downstream in the paper feed direction, and a distance from a center of the downstream paper-receiving surface to the gear mesh location, the width guide plate of the far-side paper guide has an upstream width guide plate and a downstream width guide plate, and at least one of said rack gears has teeth including different dimensions at different locations along the at least one of said rack gears.

8. A paper supply apparatus capable of being loaded into a front-loading-type image forming apparatus and permitting placement of paper therein as a result of removal/insertion operations carried out at a near side of the image forming apparatus, the paper supply apparatus comprising:

a near-side paper guide and a far-side paper guide respectively arranged so as to oppose one another, each having at least one width guide plate for constraining a portion of the paper and a rack gear extending in a direction substantially parallel to a loading direction; and a pinion gear respectively meshing with the rack gear of the near-side paper guide and the rack gear of the far-side paper guide;

wherein a paper feed direction is substantially perpendicular to the loading direction;

the far-side paper guide is constituted such that, with respect to a gear mesh location at which the pinion gear and the far-side paper guide rack gear mutually mesh, an area of a surface of the width guide plate of the far-side paper guide that receives a portion of the paper and that is upstream, being located upstream in the paper feed direction, is substantially equal to an area of a surface of the width guide plate of the far-side paper guide that receives a portion of the paper and that is downstream, being located downstream in the paper feed direction;

the width guide plate of the far-side paper guide has an upstream width guide plate and a downstream width guide plate;

a distance between an upstream end of the upstream width guide plate of the far-side paper guide and the gear mesh location is substantially equal to a distance between a downstream end of the downstream width guide plate of the far-side paper guide and the gear mesh location; and the rack gear of the far-side paper guide has teeth including different dimensions at different locations along the rack gear of the far-side paper guide.

9. A paper supply apparatus capable of being loaded into a front-loading-type image forming apparatus and permitting placement of paper therein as a result of removal/insertion operations carried out at a near side of the image forming apparatus, the paper supply apparatus comprising:

a near-side paper guide and a far-side paper guide respectively arranged so as to oppose one another, each having at least one width guide plate for constraining a portion of the paper and a rack gear extending in a direction substantially parallel to a loading direction; and a pinion gear respectively meshing with the rack gear of the near-side paper guide and the rack gear of the far-side paper guide;

wherein a paper feed direction is substantially perpendicular to the loading direction, the far-side paper guide is constituted such that the width guide plate of the far-side paper guide thereof are disposed so that a torque, about a gear mesh location at which the pinion gear and the far-side paper guide rack gear mutually mesh, acting upstream in the paper feed direction from the gear mesh location is substantially equal to the torque, about the gear mesh location, acting downstream in the paper feed direction from the gear mesh location, the far-side width guide has an upstream width guide plate and a downstream width guide plate, and the rack gear of the far-side paper guide has teeth including different dimensions at different locations along the rack gear of the far-side paper guide.

10. A paper supply apparatus according to any of claims 1, 5, 7, 8, and 9 wherein a paper-separating tab is provided in integral fashion at each of the near-side paper guide and the far-side paper guide.

11. A paper supply apparatus according to any of claims 1, 5, 7, 8, and 9 provided with a deformation prevention unit preventing deformation of the far-side paper guide.

12. A paper supply apparatus according to any of claims 1, 5, 7, 8, and 9 wherein a reinforcing plate is provided at either a top surface or a bottom surface of the pinion gear.

13. A paper supply apparatus according to any of claims 1, 5, 7, 8, and 9 wherein the rack gear of the far-side paper guide engages with the pinion gear at a downstream side of the pinion gear with respect to the paper feed direction.

14. A paper supply apparatus according to any of claims 7 through 9 wherein a distance between an upstream end of the width guide plate of the far-side paper guide and a gear mesh location at which the rack gear of the far-side paper guide and the pinion gear meshingly engage is shorter than a distance between an upstream end of the width guide plate of the near-side paper guide and a gear mesh location at which the rack gear of the near-side paper guide and the pinion gear meshingly engage.

15. A paper supply apparatus capable of being loaded into a front-loading-type image forming apparatus and permitting placement of paper therein as a result of removal/insertion operations carried out at a near side of the image forming apparatus, the paper supply apparatus comprising:

a near-side paper guide and a far-side paper guide respectively arranged so as to oppose one another, each having at least one width guide plate for constraining a portion of the paper and a rack gear extending in a direction substantially parallel to a loading direction; and a pinion gear respectively meshing with the rack gear of the near-side paper guide and the rack gear of the far-side paper guide;

wherein a paper feed direction is substantially perpendicular to the loading direction, the far-side paper guide is constituted such that, with respect to a gear mesh location at which the pinion gear and the far-side paper guide rack gear mutually mesh, a product of an area of a surface of the width guide plate of the far-side paper guide that receives a portion of the paper and that is upstream, being located upstream in the paper feed direction, and a distance from a center of the upstream paper-receiving surface to the gear mesh location is substantially equal to a product of an area of a surface of the width guide plate of the far-side paper guide that receives a portion of the paper and that is downstream, being located downstream in the paper feed direction, and a distance from a center of the downstream paper-receiving surface to the gear mesh location, the width guide plate of the far-side paper guide has an upstream width guide plate and a downstream width guide plate, and the rack gear of the far-side paper guide is provided, at a specific location thereof in the loading direction, with a region at which a manner of meshing between the pinion gear and the rack gear of the far-side paper guide is different from a manner of meshing therebetween at another portion thereof.

16. A paper supply apparatus capable of being loaded into a front-loading-type image forming apparatus and permitting placement of paper therein as a result of removal/insertion operations carried out at a near side of the image forming apparatus, the paper supply apparatus comprising:

a near-side paper guide and a far-side paper guide respectively arranged so as to oppose one another, each having at least one width guide plate for constraining a portion of the paper and a rack gear extending in a direction substantially parallel to a loading direction; and a pinion gear respectively meshing with the rack gear of the near-side paper guide and the rack gear of the far-side paper guide;

wherein a paper feed direction is substantially perpendicular to the loading direction, the far-side paper guide is constituted such that, with respect to a gear mesh location at which the pinion gear and the far-side paper guide rack gear mutually mesh, an area of a surface of the width guide plate of the far-side paper guide that receives a portion of the paper and that is upstream, being located upstream in the paper feed direction, is substantially equal to an area of a surface of the width guide plate of the far-side paper guide that receives a portion of the paper and that is downstream, being located downstream in the paper feed direction, the width guide plate of the far-side paper guide has an upstream width guide plate and a downstream width guide plate, a distance between an upstream end of the upstream width guide plate of the far-side paper guide and the gear mesh location is substantially equal to a distance between a downstream end of the downstream width guide plate of the far-side paper guide and the gear mesh location, and the rack gear of the far-side paper guide is provided, at a specific location thereof in the loading direction, with a region at which a manner of meshing between the pinion gear and the rack gear of the far-side paper guide is different from a manner of meshing therebetween at another portion thereof.

17. A paper supply apparatus capable of being loaded into a front-loading-type image forming apparatus and permitting placement of paper therein as a result of removal/insertion operations carried out at a near side of the image forming apparatus, the paper supply apparatus comprising:

a near-side paper guide and a far-side paper guide respectively arranged so as to oppose one another, each having at least one width guide plate for constraining a portion of the paper and a rack gear extending in a direction substantially parallel to a loading direction; and a pinion gear respectively meshing with the rack gear of the near-side paper guide and the rack gear of the far-side paper guide;

wherein a paper feed direction is substantially perpendicular to the loading direction, the far-side paper guide is constituted such that the width guide plate of the far-side paper guide thereof are disposed so that a torque, about a gear mesh location at which the pinion gear and the far-side paper guide rack gear mutually mesh, acting upstream in the paper feed direction from the gear mesh location is substantially equal to the torque, about the gear mesh location, acting downstream in the paper feed direction from the gear mesh location, the far-side width guide has an upstream width guide plate and a downstream width guide plate, and the rack gear of the far-side paper guide is provided, at a specific location thereof in the loading direction, with a region at which a manner of meshing between the pinion gear and the rack gear of the far-side paper guide is different from a manner of meshing therebetween at another portion thereof.

* * * * *